US010688352B2

(12) United States Patent
Harbert et al.

(10) Patent No.: US 10,688,352 B2
(45) **Date of Patent: *Jun. 23, 2020**

(54) GOLF CLUB HEAD

(71) Applicant: Taylor Made Golf Company, Inc., Carlsbad, CA (US)

(72) Inventors: Christopher John Harbert, Carlsbad, CA (US); Joseph Reeve Nielson, Vista, CA (US); Nathan T. Sargent, Oceanside, CA (US); Christian Reber Wester, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 80 days.

This patent is subject to a terminal disclaimer.

(21) Appl. No.: 16/058,845

(22) Filed: Aug. 8, 2018

(65) Prior Publication Data

US 2019/0022480 A1 Jan. 24, 2019

Related U.S. Application Data

(63) Continuation of application No. 15/254,999, filed on Sep. 1, 2016, now Pat. No. 10,076,688, which is a (Continued)

(51) Int. Cl.
*A63B 53/04* (2015.01)
*A63B 53/02* (2015.01)

(52) U.S. Cl.
CPC .... *A63B 53/0466* (2013.01); *A63B 2053/023* (2013.01); *A63B 2053/027* (2013.01);

(Continued)

(58) Field of Classification Search
CPC ..... A63B 53/0466; A63B 2053/0433; A63B 2053/0491; A63B 2053/023;

(Continued)

(56) References Cited

U.S. PATENT DOCUMENTS 3,897,066 A 7/1975 Belmont
5,447,309 A 9/1995 Vincent (Continued)

FOREIGN PATENT DOCUMENTS

GB 20747 A 9/1920
JP 2006320493 11/2006

OTHER PUBLICATIONS

Bond Laminates, "Advanced thermoplastic composites—Tepex", Oct. 2013, pp. 1-7.

(Continued)

*Primary Examiner* — Sebastiano Passaniti
(74) *Attorney, Agent, or Firm* — Klarquist Sparkman LLP

(57) ABSTRACT

A golf club head includes a metal frame having a sole opening, a composite laminate crown joined to the frame, a composite laminate sole insert joined to the frame and overlying the sole opening, and a thermoplastic composite component overmolded on the sole insert. The composite component may include a weight track, ribs, supports or other features. A method of making the golf club includes the steps of forming a frame having a sole opening, forming a composite laminate sole insert, forming a composite laminate crown insert, injection molding a thermoplastic composite head component over the sole insert to create a sole insert unit, and joining the sole insert unit and crown insert to the frame.

20 Claims, 20 Drawing Sheets

Related U.S. Application Data continuation of application No. 15/087,002, filed on Mar. 31, 2016, now Pat. No. 9,914,027.

(60) Provisional application No. 62/205,601, filed on Aug. 14, 2015.

(52) U.S. Cl.
CPC ..... *A63B 2053/0408* (2013.01); *A63B 2053/0433* (2013.01); *A63B 2053/0437* (2013.01); *A63B 2053/0491* (2013.01)

(58) Field of Classification Search
CPC .... A63B 2053/0408; A63B 2053/0437; A63B 2053/027
USPC ..... 473/324–350, 287–292
See application file for complete search history.

(56) References Cited

U.S. PATENT DOCUMENTS 5,624,331 A 4/1997 Lo et al.
5,935,020 A 8/1999 Stites et al.
5,997,415 A 12/1999 Wood
6,123,627 A 9/2000 Antonious
6,146,571 A 11/2000 Vincent et al.
6,254,494 B1 7/2001 Hasebe
6,277,032 B1 * 8/2001 Smith ..... A63B 53/04 473/336
6,648,773 B1 11/2003 Evans
6,663,503 B1 12/2003 Kenmi
6,824,860 B2 11/2004 Edwards et al.
6,872,152 B2 3/2005 Beach et al.
6,929,565 B2 8/2005 Nakahara et al.
6,939,247 B1 9/2005 Schweigert et al.
6,945,876 B2 9/2005 Nakahara et al.
6,991,558 B2 1/2006 Beach et al.
7,063,629 B2 6/2006 Nakahara et al.
7,108,612 B2 9/2006 Nakahara et al.
7,147,577 B2 12/2006 Nakahara et al.
7,169,064 B2 1/2007 Nakahara et al.
7,198,575 B2 4/2007 Beach et al.
7,214,142 B2 5/2007 Meyer et al.
7,217,199 B2 5/2007 Nakahara et al.
7,273,423 B2 9/2007 Imamoto
7,303,487 B2 12/2007 Kumamoto
7,306,527 B2 12/2007 Williams et al.
7,371,191 B2 5/2008 Sugimoto
7,419,441 B2 * 9/2008 Hoffman ..... A63B 53/0466 473/334
7,530,901 B2 5/2009 Imamoto et al.
7,559,853 B2 7/2009 Hirano
7,572,193 B2 * 8/2009 Yokota ..... A63B 53/0466 473/328
7,611,424 B2 11/2009 Nagai et al.
7,691,008 B2 4/2010 Oyama
7,775,905 B2 8/2010 Beach et al.
7,824,280 B2 11/2010 Yokota
7,887,436 B2 2/2011 Hirano
7,954,526 B2 6/2011 Chen
7,993,216 B2 8/2011 Lee
8,012,038 B1 9/2011 Beach et al.
8,016,694 B2 * 9/2011 Llewellyn ..... A63B 53/0466 473/334
8,192,303 B2 6/2012 Ban
8,298,096 B2 6/2012 Stites et al.
8,226,501 B2 7/2012 Stites et al.
8,425,349 B2 4/2013 Dawson et al.
8,430,763 B2 4/2013 Beach et al.
8,435,137 B2 5/2013 Hirano
8,444,505 B2 5/2013 Beach et al.
8,550,934 B2 10/2013 Evans
8,579,722 B1 11/2013 Beach et al.
8,608,591 B2 12/2013 Chao et al.
8,696,491 B1 4/2014 Myers
8,708,838 B2 4/2014 Ferguson et al.
8,734,271 B2 5/2014 Beach et al.
8,758,153 B2 * 6/2014 Sargent ..... A63B 53/02 473/246
8,771,097 B2 7/2014 Bennett et al.
8,834,294 B1 * 9/2014 Seluga ..... A63B 53/04 473/338
8,870,678 B2 10/2014 Beach et al.
8,882,609 B2 11/2014 Boyd et al.
8,900,069 B2 12/2014 Beach et al.
8,926,450 B2 1/2015 Takahashi et al.
8,979,671 B1 3/2015 DeMille et al.
9,089,747 B2 7/2015 Boyd et al.
9,101,811 B1 8/2015 Goudarzi et al.
9,162,120 B2 10/2015 Jertson et al.
9,168,435 B1 10/2015 Boggs et al.
9,174,096 B2 11/2015 Sargent et al.
9,180,349 B1 11/2015 Seluga et al.
9,199,145 B1 12/2015 Myers
9,211,449 B2 12/2015 Demille et al.
9,211,453 B1 12/2015 Foster et al.
9,216,332 B1 12/2015 Ehlers et al.
9,238,162 B2 1/2016 Breier et al.
9,259,625 B2 2/2016 Sargent et al.
9,278,262 B2 3/2016 Sargent et al.
9,283,449 B1 3/2016 Demille et al.
9,289,660 B1 3/2016 Myers
9,358,432 B2 * 6/2016 Boggs ..... A63B 53/06
9,393,471 B2 7/2016 Beno et al.
9,421,438 B2 8/2016 Beno et al.
9,433,836 B2 * 9/2016 Breier ..... A63B 53/0466
9,561,413 B2 2/2017 Nielson et al.
9,636,556 B2 5/2017 Beck et al.
9,744,412 B2 8/2017 Boggs et al.
9,746,354 B2 8/2017 Martin et al.
9,757,630 B2 * 9/2017 Mata ..... A63B 53/06
9,764,210 B2 9/2017 Curtis et al.
9,914,027 B1 3/2018 Harbert et al.
10,076,688 B1 9/2018 Harbert et al.
10,183,202 B1 * 1/2019 Harbert ..... A63B 53/0466
10,207,160 B2 * 2/2019 Johnson ..... A63B 53/0466
2002/0160854 A1 10/2002 Beach et al.
2003/0175520 A1 9/2003 Grutta et al.
2003/0236132 A1 12/2003 Burrows
2004/0116207 A1 6/2004 DeShiell et al.
2004/0121853 A1 6/2004 Caldwell et al.
2005/0159243 A1 7/2005 Chuang
2006/0052177 A1 3/2006 Nakahara et al.
2006/0105856 A1 * 5/2006 Lo ..... A63B 53/04 473/334
2006/0122004 A1 6/2006 Chen et al.
2006/0135281 A1 6/2006 Palumbo et al.
2006/0229141 A1 10/2006 Galloway
2007/0049416 A1 3/2007 Shear
2008/0051218 A1 2/2008 Rae et al.
2008/0113827 A1 5/2008 Werner et al.
2008/0139334 A1 6/2008 Willett et al.
2008/0139339 A1 6/2008 Cheng
2008/0153624 A1 6/2008 Ban et al.
2008/0261715 A1 10/2008 Carter
2010/0075773 A1 3/2010 Casati, Jr.
2010/0125000 A1 5/2010 Lee
2010/0137074 A1 6/2010 Gilbert et al.
2010/0144461 A1 6/2010 Ban
2010/0292027 A1 11/2010 Beach et al.
2011/0159986 A1 6/2011 Chao et al.
2012/0094781 A1 4/2012 Breier et al.
2012/0108358 A1 5/2012 Sugimoto
2012/0122601 A1 5/2012 Beach et al.
2012/0220387 A1 8/2012 Beach et al.
2012/0295504 A1 11/2012 Miyauchi et al.
2013/0090185 A1 * 4/2013 Boyd ..... A63B 53/0466 473/337
2013/0130831 A1 5/2013 Morales et al.
2013/0178306 A1 7/2013 Beno et al.
2013/0184098 A1 7/2013 Boyd et al.
2013/0344976 A1 12/2013 Stites et al.
2014/0057737 A1 2/2014 Solheim et al.
2014/0080617 A1 3/2014 Llewellyn et al.

(56) References Cited

U.S. PATENT DOCUMENTS

| | | | | |
|---|---|---|---|---|
| 2014/0080622 | A1* | 3/2014 | Sargent | A63B 53/02 473/307 |
| 2014/0080628 | A1 | 3/2014 | Sargent et al. | |
| 2014/0113742 | A1 | 4/2014 | Zimmerman et al. | |
| 2014/0162809 | A1 | 6/2014 | Soracco | |
| 2015/0031468 | A1 | 1/2015 | Matsunaga et al. | |
| 2015/0038258 | A1 | 2/2015 | Beach et al. | |
| 2015/0038259 | A1 | 2/2015 | Sander | |
| 2015/0057101 | A1 | 2/2015 | Sander | |
| 2015/0119165 | A1 | 4/2015 | Sander | |
| 2015/0297961 | A1 | 10/2015 | Voshall et al. | |
| 2015/0306473 | A1 | 10/2015 | Breier et al. | |
| 2015/0306474 | A1* | 10/2015 | Breier | A63B 53/0466 473/332 |
| 2015/0321055 | A1 | 11/2015 | Golden et al. | |
| 2016/0001146 | A1 | 1/2016 | Sargent et al. | |
| 2016/0008687 | A1 | 1/2016 | Sargent et al. | |
| 2016/0136490 | A1 | 5/2016 | Sargent et al. | |
| 2016/0287954 | A1 | 10/2016 | Sargent et al. | |
| 2016/0303443 | A1 | 10/2016 | Boggs et al. | |
| 2016/0346643 | A1 | 12/2016 | Akiyama | |
| 2016/0375326 | A1* | 12/2016 | Nunez | A63B 60/52 473/335 |
| 2017/0087429 | A1 | 3/2017 | Nielson et al. | |
| 2018/0021641 | A1* | 1/2018 | Hall | A63B 53/06 473/335 |

OTHER PUBLICATIONS

"Exposed: Peek Inside 9 of the Hottest Drivers in Golf," Tony Covey, Aug. 2, 2016, https://mygolfspy.com/a-look-inside-9-drivers/.

* cited by examiner

GOLF CLUB HEAD

CROSS REFERENCE TO RELATED APPLICATION

This application is a continuation of U.S. patent application Ser. No. 15/254,999, filed Sep. 1, 2016, which application is a continuation of U.S. patent application Ser. No. 15/087,002, filed Mar. 31, 2016, which application claims the benefit of U.S. Provisional Application No. 62/205,601, which was filed on Aug. 14, 2015, all of which applications are incorporated herein by reference in their entireties.

BACKGROUND

With the ever-increasing popularity and competitiveness of golf, substantial effort and resources are currently being expended to improve golf clubs. Much of the recent improvement activity has involved the combination of the use of new and increasingly more sophisticated materials in concert with advanced club-head engineering. For example, modern "wood-type" golf clubs (notably, "drivers," "fairway woods," and "utility or hybrid clubs"), with their sophisticated shafts and non-wooden club-heads, bear little resemblance to the "wood" drivers, low-loft long-irons, and higher numbered fairway woods used years ago. These modern wood-type clubs are generally called "metalwoods" since they tend to be made of strong, lightweight metals, such as titanium.

An exemplary metalwood golf club such as a driver or fairway wood typically includes a hollow shaft having a lower end to which the club-head is attached. Most modern versions of these club-heads are made, at least in part, of a lightweight but strong metal such as titanium alloy. In most cases, the club-head comprises a body to which a face plate (used interchangeably herein with the terms "face" or "face insert" or "striking plate" or "strike plate") is attached or integrally formed. The strike plate defines a front surface or strike face that actually contacts the golf ball.

Some current approaches to reducing structural mass of a metalwood club-head are directed to making at least a portion of the club-head of an alternative material. Whereas the bodies and face plates of most current metalwoods are made of titanium alloy, several club-heads are available that are made, at least in part, of components formed from either graphite/epoxy-composite (or other suitable composite material) and a metal alloy. Graphite composites have a density of approximately 1.5 g/cm$^3$, compared to titanium alloy which has a density of 4.5 g/cm$^3$, which offers tantalizing prospects for providing more discretionary mass in the club-head.

The ability to utilize such materials to increase the discretionary mass available for placement at various points in the club-head allows for optimization of a number of physical properties of the club-head which can greatly impact the performance obtained by the user. Forgiveness on a golf shot is generally maximized by configuring the golf club head such that the center of gravity ("CG") of the golf club head is optimally located and the moment of inertia ("MOI") of the golf club head is maximized.

However, to date there have been relatively few golf club head constructions involving a polymeric material as an integral component of the design. Although such materials possess the requisite light weight to provide for significant weight savings, it is often difficult to utilize these materials in areas of the club head subject to stresses resulting from the high speed impact of the golf ball.

For example, some current metalwoods incorporate weight tracks in the sole to support slidable weights which allow the golfer to adjust the performance characteristics of the club by changing the weight position and effective center of gravity (CG) of the club head. The weight track is generally made from cast titanium to handle the high stress resulting from the high speed impact of the golf ball. Although titanium and titanium alloys are comparatively light in the context of other metals, titanium is still relatively heavy, requires a number of reinforcing ribs and produces undesirably low first modal frequencies (when the ball is struck). A heavier construction for the weight track and ribs means less discretionary weight is available for placement in strategic locations that benefit club performance.

SUMMARY

In one embodiment, the golf club head may include a sole insert made of a material suitable to have a part injection molded thereto, and a thermoplastic composite head component overmolded on the sole insert to create a sole insert unit. The sole insert unit is joined to the frame and overlies the sole opening.

The composite head component overmolded on the sole insert may include one or more ribs to reinforce the head, one or more ribs to tune acoustic properties of the head, one or more weight ports to receive a fixed weight in a sole portion of the head, one or more weight tracks to receive one or more slidable weights, any combinations thereof, and other features.

The sole insert may be made from a thermoplastic composite material, thermoplastic carbon composite material, a continuous fiber thermoplastic composite material suitable for thermoforming, as well as other materials.

The weight track may be made from a thermoplastic composite material including a matrix compatible for binding with the sole insert material.

The golf club head may include a sole insert and weight track, each of which is made from a thermoplastic composite material having a compatible matrix to facilitate injection molding the weight track over the sole insert.

The sole insert and weight track each may be made from a thermoplastic carbon composite material having a compatible matrix selected from the group consisting of, for example, polyphenylene sulfide (PPS), nylon, polyamides, polypropylene, thermoplastic polyurethanes, thermoplastic polyureas, polyamide-amides (PAI), polyether amides (PEI), polyetheretherketones (PEEK), and any combination thereof.

The sole insert may also be made from a thermoset composite material suitable for thermosetting and coated with a heat activated adhesive to facilitate the weight track being injection molded over the sole insert.

The frame may be made from a metal material such as, for example, titanium, one or more titanium alloys, aluminum, one or more aluminum alloys, steel, one or more steel allows, and any combination thereof.

The sole and crown inserts may be made of a thermoplastic composite material including fibers such as, for example, glass fibers, aramide fibers, carbon fibers and any combination thereof, and include a thermoplastic matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof.

The sole insert and/or crown insert may be thermoformed from a continuous fiber composite material.

The golf club head may include a metal frame having a sole opening, a composite laminate crown insert joined to the frame, a composite laminate sole insert joined to the frame and overlying the sole opening, and a thermoplastic composite weight track overmolded on the sole insert.

A method of making the golf club head may include forming a frame having a sole opening, forming a composite laminate sole insert, injection molding a thermoplastic composite head component over the sole insert to create a sole insert unit, and joining the sole insert unit to the frame.

The sole and crown inserts may be formed by thermoforming using composite materials suitable for thermoforming.

The sole and/or crown inserts may be formed by thermosetting using materials suitable for thermosetting.

The thermoset sole and/or crown insert may be coated with a heat activated adhesive to facilitate injection molding a thermoplastic composite component over the sole and/or crown insert, such as one or more weight tracks, weight ports, ribs, supports or other features for strengthening, adding rigidity, acoustic tuning or other purposes.

The foregoing and other objects, features, and advantages of the invention will become more apparent from the following detailed description, which proceeds with reference to the accompanying figures.

DETAILED DESCRIPTION

The following describes embodiments of golf club heads in the context of a driver-type golf club, but the principles, methods and designs described may be applicable in whole or in part to fairway woods, utility clubs (also known as hybrid clubs) and the like.

The following inventive features include all novel and non-obvious features disclosed herein both alone and in novel and non-obvious combinations with other elements. As used herein, the phrase "and/or" means "and," "or" and both "and" and "or." As used herein, the singular forms "a," "an" and "the" refer to one or more than one, unless the context clearly dictates otherwise. As used herein, the term "includes" means "comprises."

The following also makes reference to the accompanying drawings which form a part hereof. The drawings illustrate specific embodiments, but other embodiments may be formed and structural changes may be made without departing from the intended scope of this disclosure. Directions and references (e.g., up, down, top, bottom, left, right, rearward, forward, heelward, toeward, etc.) may be used to facilitate discussion of the drawings but are not intended to be limiting. For example, certain terms may be used such as "up," "down," "upper," "lower," "horizontal," "vertical," "left," "right" and the like. These terms are used where applicable, to provide some clarity of description when dealing with relative relationships, particularly with respect to the illustrated embodiments. Such terms are not, however, intended to imply absolute relationships, positions and/or orientations. For example, with respect to an object, an "upper" surface can become a "lower" surface simply by turning the object over. Nevertheless, it is still the same object. Accordingly, the following detailed description shall not be construed in a limiting sense and the scope of property rights sought shall be define by the appended claims and their equivalents.

Figure 1:
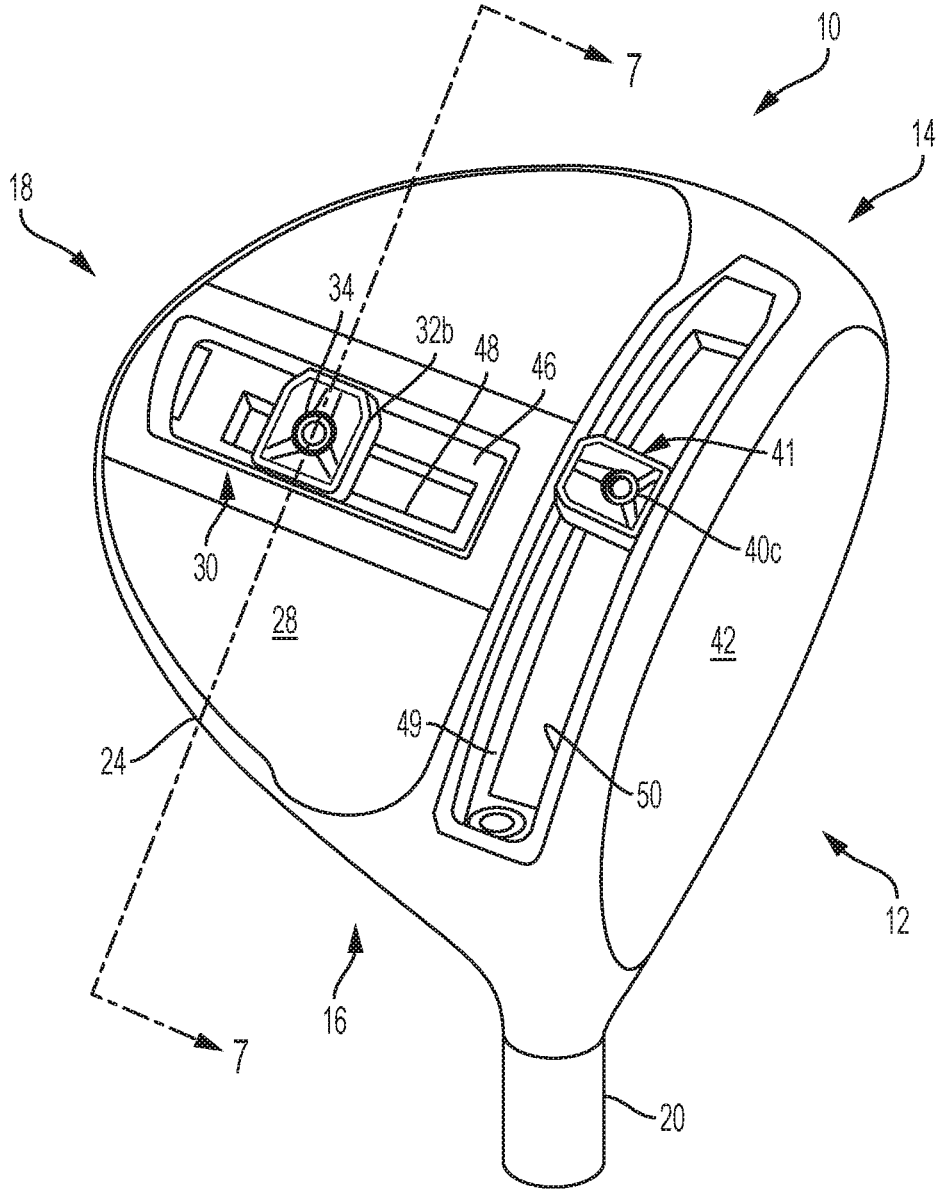
FIG. 1 is a bottom perspective view of a golf club head in accordance with one embodiment.
Figure 2:
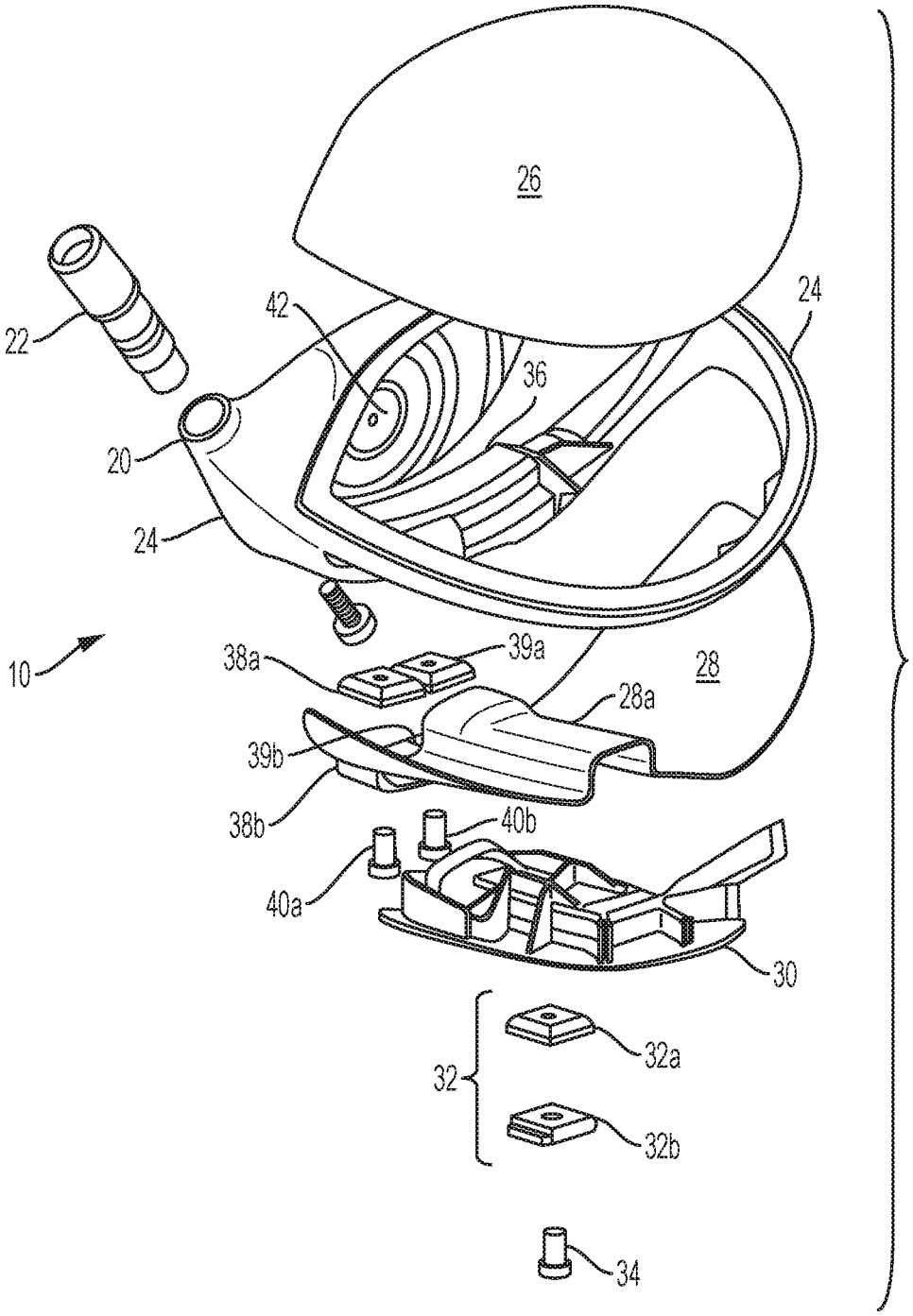
FIG. 2 is an exploded perspective view of the golf club head of FIG. 1 showing two slidable weights in a forwardly located weight track.
Figure 5:
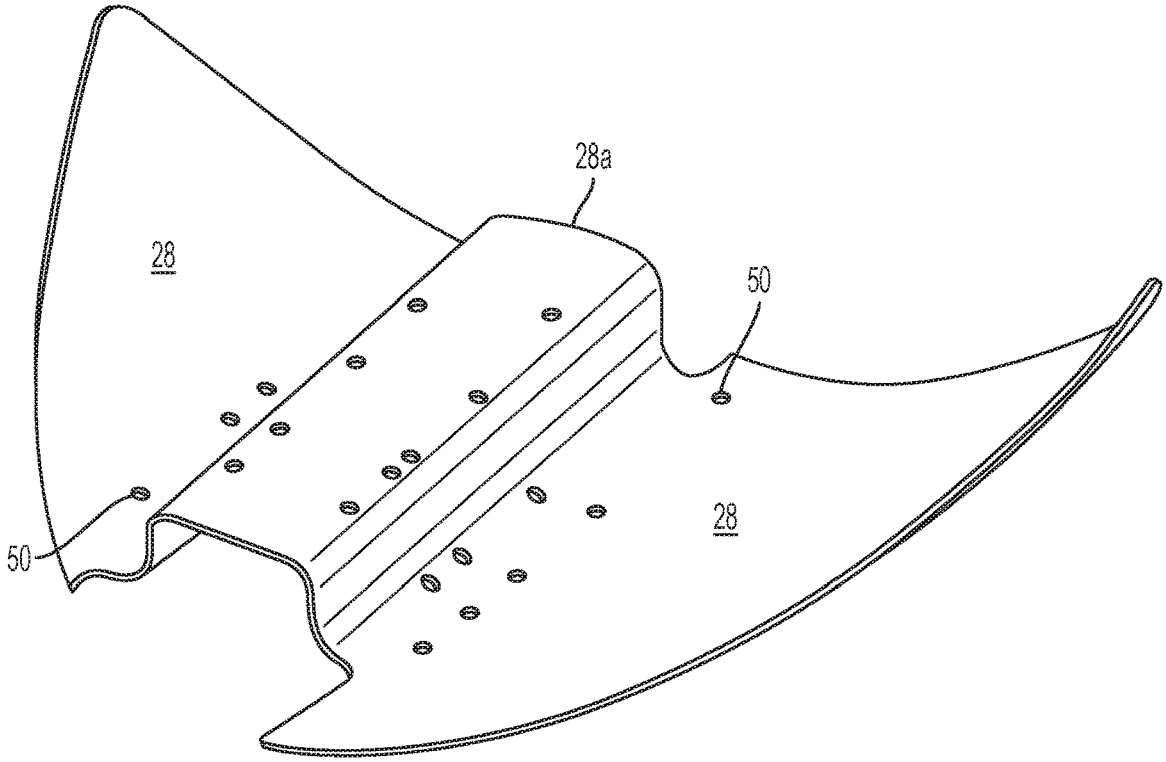
FIG. 5 is a perspective view of a sole insert portion of the golf club head of FIG. 1 or FIG. 2.
Figure 6:
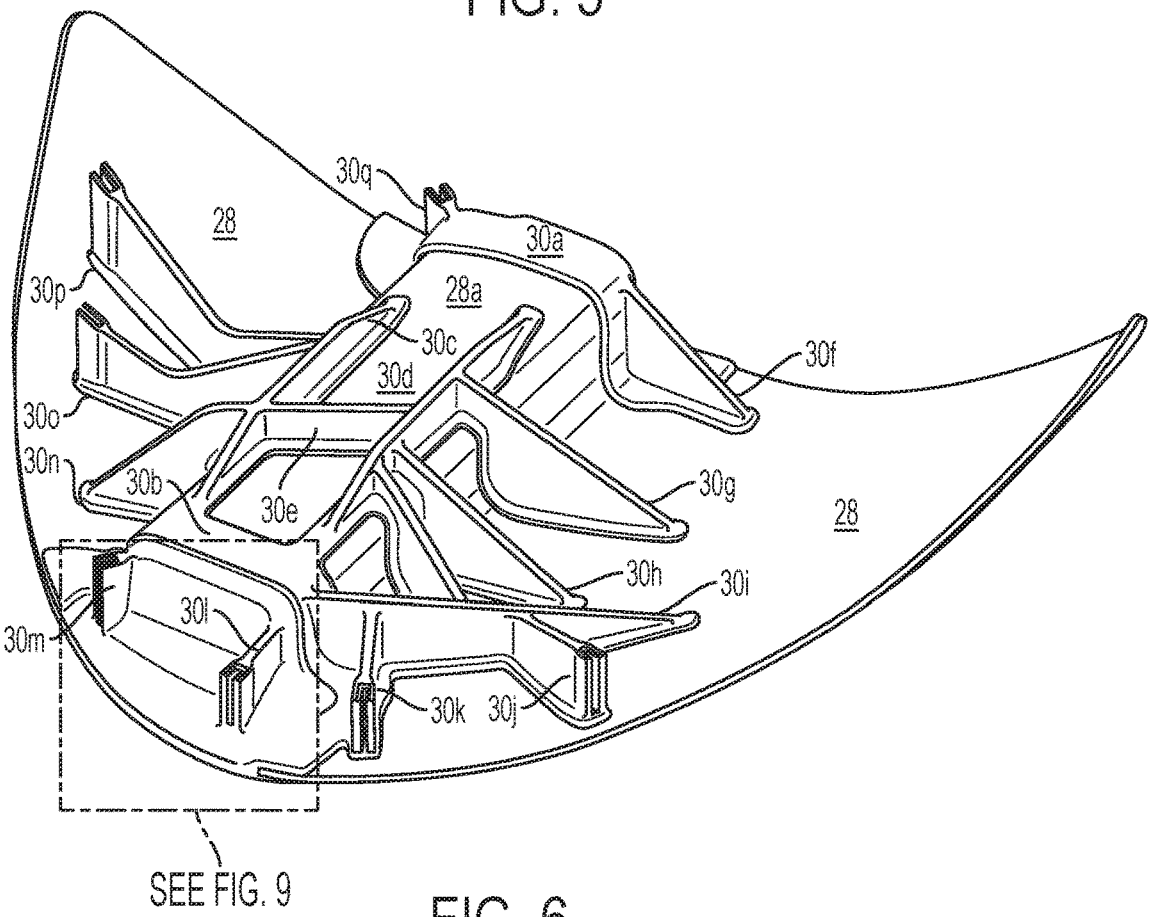
FIG. 6 is a perspective view of the sole insert of FIG. 2 or FIG. 5 with additional features molded over the sole insert.
Figure 7:
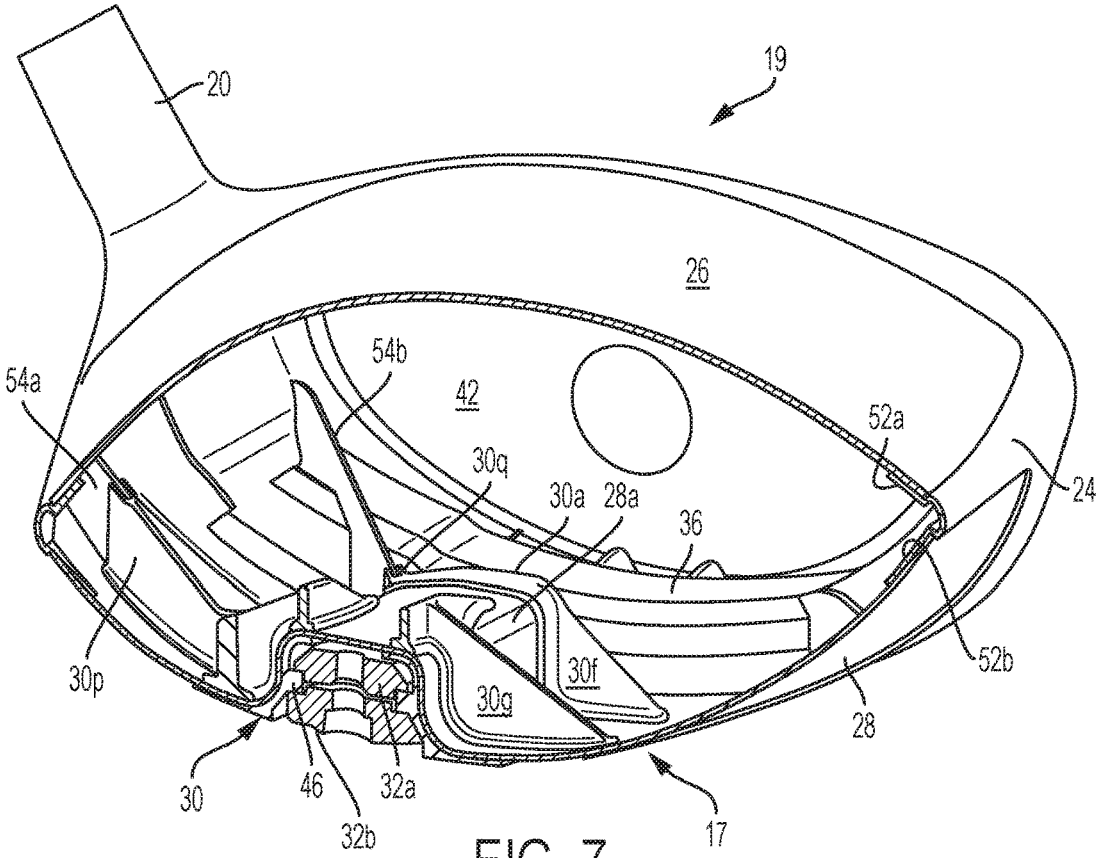
FIG. 7 is a vertical cross section taken generally along line 7-7 of FIG. 1.
Figure 8:
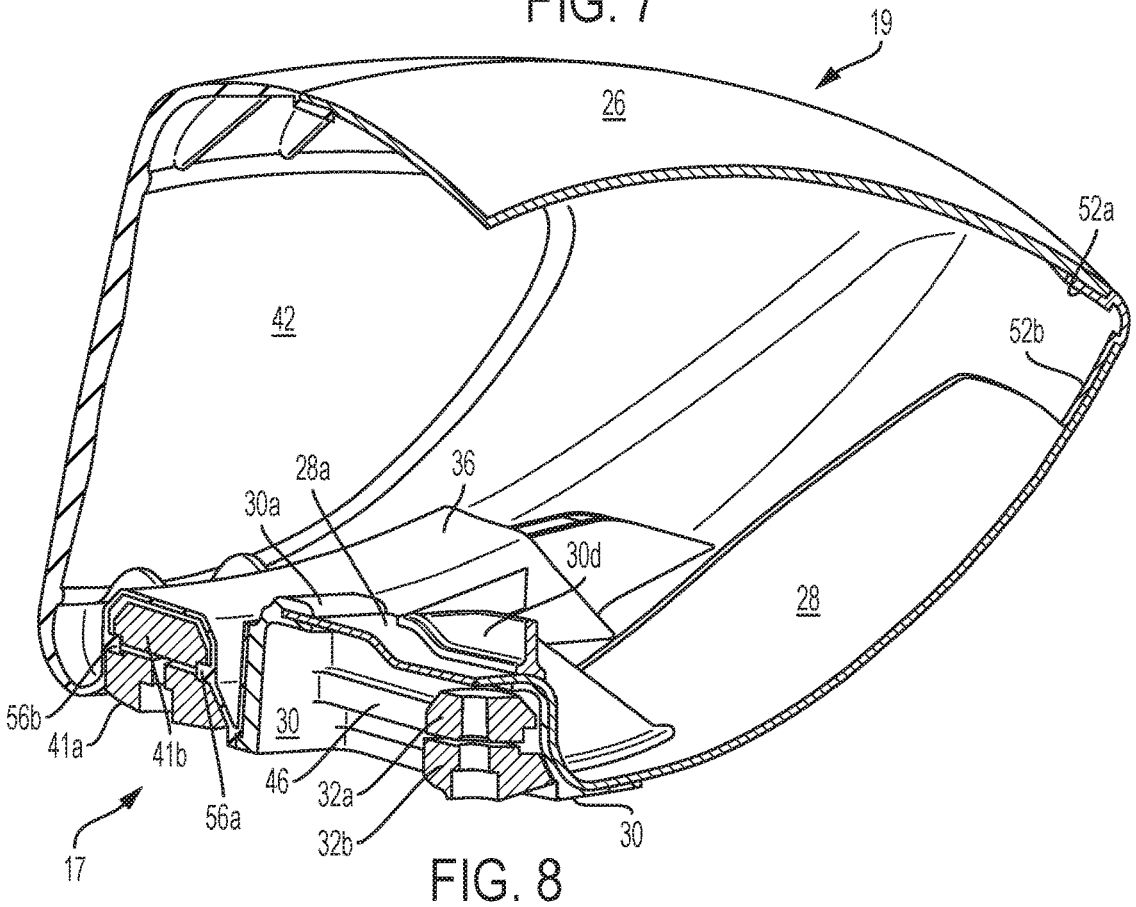
FIG. 8 is a vertical cross section taken generally along line 8-8 of FIG. 3.

In one example, a driver-type club head 10 is shown in FIGS. 1-10. As shown in FIG. 1, the head 10 has a forward face area 12, toe area 14, heel area 16 opposite the toe area 14, and a rear or aft area 18 opposite the forward face area 12. FIGS. 7-8 illustrate other views of the club head 10 including a sole area 17 and crown area 19 opposite the sole area 17. On the heel side of the club head, the head has a hosel 20 to which a golf club shaft may be attached directly or, alternatively, to which a FCT component (flight control technology, also known as an adjustable lie/loft assembly)

may be attached as shown in FIG. 2. (The other figures show the hosel 20 without the FCT component attached thereto.)

FIG. 2 is an exploded view of various components of the club head 10. The club head may include a main body or frame 24, crown insert 26, sole insert 28, weight track 30, and FCT component 22. The weight track 30 is located in the sole of the club head and defines a track for mounting a two-piece slidable weight 32, which may be fastened to the weight track by a fastening means such as a screw 34. The weight 32 can take forms other than as shown in FIG. 2, can be mounted in other ways, and can take the form of a single piece design or multi-piece design (such as a two-piece design having weight elements 32*a*, 32*b* as shown in FIG. 2). The weight track allows the weight 32 to be loosened for slidable adjustment fore and aft along the track and then tightened in place to adjust the effective CG of the club head in the front to rear direction. By shifting the club head's CG forward or rearward, the performance characteristics of the club head can be modified to affect the flight of the golf ball, especially spin characteristics of the golf ball.

The sole of the frame 24 preferably is integrally formed with a lateral weight track 36, which extends generally parallel to and near the face of the club head and generally perpendicular to the weight track 30. The lateral weight track 36 defines a track or port for mounting (in one exemplary embodiment) one or more slidable weights that are fastened to the weight track. In the example shown in FIG. 2, two two-piece lateral weights 38*a, b*, 39*a, b*, are fastened by fastening means, such as respective screws 40*a*, 40*b*, to the lateral weight track. The weights 38*a, b*, 39*a, b* can take other shapes than as shown, can be mounted in other ways, and can take the form of a single-piece design or multi-piece design.

Figure 3:
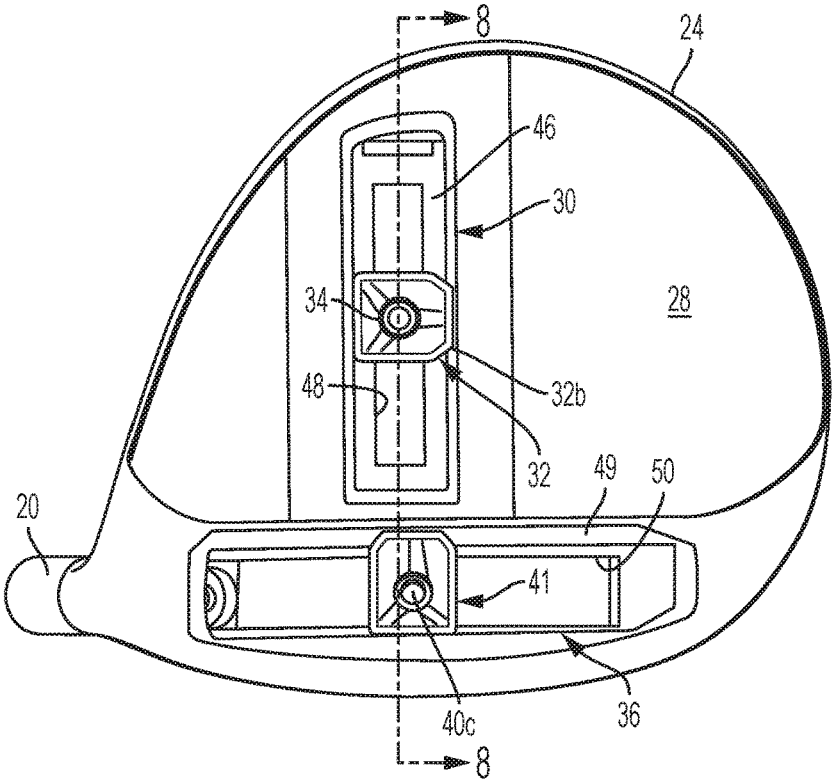
FIG. 3 is bottom plan view of the golf club head of FIG. 1.

Unlike FIG. 2, FIG. 3 shows an embodiment in which the lateral weight track 36 slideably mounts only on one lateral weight 41. The weight 41 may comprise a single weight element, multiple weight elements or two stacked weight elements fastened together by a screw 40. See also FIG. 1 showing a single weight 41 slideably mounted in the weight track.

The lateral weight track of FIG. 2 allows the weights 38, 39 to be loosened for slidable adjustment laterally in the heel-toe direction and then tightened in place to adjust the CG of the club head in the heel-toe direction. This is accomplished by loosening screws 40*a*, 40, adjusting the weights and then tightening the screws 40*a*, 40*b*. By adjusting the CG heelward or toeward, the performance characteristics of the club head can be modified to affect the flight of the ball, especially the ball's tendency to draw or fade, or to counter the ball's tendency to slice or hook. Notably, the use of two weights 38, 39 (FIG. 2) allows for adjustment and interplay between the weights. For example, both weights can be positioned fully on the toe side, fully on the heel side, spaced apart a maximum distance with one weight fully on the toe side and the other fully on the heel side, positioned together in the middle of the weight track, or in other weight location patterns.

With the single lateral weight design shown in FIG. 3, the weight adjustment options are more limited but the effective CG of the head still can be adjusted along a continuum heelward or toeward, or left in a neutral position with the weight centered in the weight track.

The frame 24 preferably has a lower sole opening sized and configured to receive the sole insert 28, and an upper crown opening sized and configured to receive the crown insert 26. More specifically, the sole opening receives a sole insert unit including the sole insert 28 and weight track 30 joined thereto (as described below). The sole and crown openings are each formed to have a peripheral edge or recess to seat, respectively, the sole insert unit and crown insert 26, such that the sole and crown inserts are either flush with the frame 24 to provide a smooth seamless outer surface or, alternatively, slightly recessed.

Though not shown, the frame 24 preferably has a face opening to receive a face plate or strike plate 42 that is attached to the frame by welding, braising, soldering, screws or other fastening means. FIG. 2 and the other figures generally show the face plate already joined to the frame.

The frame 24 may be made from a variety of different types of materials but in one example is made of a metal material such as a titanium or titanium alloy (including but not limited to 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075). The frame may be formed by conventional casting, metal stamping or other known processes. The frame also may be made of other metals as well as non-metals. The frame provides a framework or skeleton for the club head to strengthen the club head in areas of high stress caused by the golf ball's impact with the face, such as the transition region where the club head transitions from the face to the crown area, sole area and skirt area located between the sole and crown areas.

In one exemplary embodiment, the sole insert 28 and/or crown insert 26 may be made from a variety of composite and polymeric materials, and preferably from a thermoplastic material, more preferably from a thermoplastic composite laminate material, and most preferably from a thermoplastic carbon composite laminate material. For example, the composite material may be an injection moldable material, thermoformable material, thermoset composite material or other composite material suitable for golf club head applications. One exemplary material is a thermoplastic continuous carbon fiber composite laminate material having long, aligned carbon fibers in a PPS (polyphenylene sulfide) matrix or base. One commercial example of this type of material, which is manufactured in sheet form, is TEPEX® DYNALITE 207 manufactured by Lanxess.

TEPEX® DYNALITE 207 is a high strength, lightweight material having multiple layers of continuous carbon fiber reinforcement in a PPS thermoplastic matrix or polymer to embed the fibers. The material may have a 54% fiber volume but other volumes (such as a volume of 42 to 57%) will suffice. The material weighs 200 g/m$^2$.

Another similar exemplary material which may be used for the crown and sole inserts is TEPEX® DYNALITE 208. This material also has a carbon fiber volume range of 42 to 57%, including a 45% volume in one example, and a weight of 200 g/m$^2$. DYNALITE 208 differs from DYNALITE 207 in that it has a TPU (thermoplastic polyurethane) matrix or base rather than a polyphenylene sulfide (PPS) matrix.

By way of example, the TEPEX® DYNALITE 207 sheet(s) (or other selected material such as DYNALITE 208) are oriented in different directions, placed in a two-piece (male/female) matched die, heated past the melt temperature, and formed to shape when the die is closed. This process may be referred to as thermoforming and is especially well-suited for forming the sole and crown inserts.

Once the crown insert and sole insert are formed (separately) by the thermoforming process just described, each is cooled and removed from the matched die. The sole and crown inserts are shown as having a uniform thickness, which lends itself well to the thermoforming process and ease of manufacture. However, the sole and crown inserts may have a variable thickness to strengthen select local areas of the insert by, for example, adding additional plies in select areas to enhance durability, acoustic or other properties in those areas.

As shown in FIG. 2, the crown insert 26 and sole insert 28 each have a complex three-dimensional curvature corresponding generally to the crown and sole shapes of a driver-type club head and specifically to the design specifications and dimensions of the particular head designed by the manufacturer. It will be appreciated that other types of club heads, such as fairway wood-type clubs, may be manufactured using one or more of the principles, methods and materials described herein.

In an alternative embodiment, the sole insert 28 and/or crown insert 26 can be made by a process other than thermoforming, such as injection molding or thermosetting. In a thermoset process, the sole insert and/or crown insert may be made from prepreg plies of woven or unidirectional composite fiber fabric (such as carbon fiber) that is preimpregnated with resin and hardener formulations that activate when heated. The prepreg plies are placed in a mold suitable for a thermosetting process, such as a bladder mold or compression mold, and stacked/oriented with the carbon or other fibers oriented in different directions. The plies are heated to activate the chemical reaction and form the sole (or crown) insert. Each insert is cooled and removed from its respective mold.

The carbon fiber reinforcement material for the thermoset sole/crown insert may be a carbon fiber known as "34-700" fiber, available from Grafil, Inc., of Sacramento, Calif., which has a tensile modulus of 234 Gpa (34 Msi) and tensile strength of 4500 Mpa (650 Ksi). Another suitable fiber, also available from Grafil, Inc., is a carbon fiber known as "TR50S" fiber which has a tensile modulus of 240 Gpa (35 Msi) and tensile strength of 4900 Mpa (710 Ksi). Exemplary epoxy resins for the prepreg plies used to form the thermoset crown and sole inserts are Newport 301 and 350 and are available from Newport Adhesives & Composites, Inc., of Irvine, Calif.

In one example, the prepreg sheets have a quasi-isotropic fiber reinforcement of 34-700 fiber having an areal weight of about 70 g/m$^2$ and impregnated with an epoxy resin (e.g., Newport 301), resulting in a resin content (R/C) of about 40%. For convenience of reference, the primary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%.

In a preferred embodiment, the weight track 30 which has more details and 3-D features than the sole insert 28, is made from the same, similar or at least compatible material as the sole insert to allow the weight track to be injection molded, overmolded, or insert molded over the sole insert to bond the two parts together to form the sole insert unit. The weight track 30 preferably is made from a polymeric material suitable for injection molding, preferably a thermoplastic material, more preferably a thermoplastic composite laminate material, and most preferably a thermoplastic carbon composite laminate material. One exemplary material suitable for injection molding is a thermoplastic carbon fiber composite material having short, chopped fibers in a PPS (polyphenylene sulfide) base or matrix. For example, the weight track material may include 30% short carbon fibers (by volume) having a length of about 1/10 inch, which reinforces the PPS matrix.

One example of a commercial material that may be used for the weight track is RTP 1385 UP, made by RTP Company. Other examples include nylon, RTP 285, RTP 4087 UP and RTP 1382 UP. In a preferred example, the crown insert, sole insert and weight track 30 are made from compatible materials capable of bonding well to one another such as polymeric materials having a common matrix or base, or at least complementary matrices. For example, the crown insert and sole insert may be made from continuous fiber composite material well suited for thermoforming while the weight track is made of short fiber composite material well suited for injection molding (including insert molding and overmolding), with each having a common PPS base.

The sole insert unit is formed by placing the thermoplastic composite sole insert 28 in a mold and injection molding the thermoplastic weight track 30 over the sole insert (as, for example, by insert molding or overmolding). The injection molding process creates a strong fusion-like bond between the sole insert and weight track due to their material compatibility, which preferably includes a compatible polymer/matrix (PPS in one preferred example). The terms injection molding (over), insert molding and overmolding generally refer to the same process, but to the extent there are differences, all such processes are believed to be sufficiently similar as to be suitable for forming the sole insert unit.

In the alternative process in which the sole insert 28 is formed using a thermosetting material, the thermoset sole insert and thermoplastic weight track 30 are not compatible materials and will not bond well if left untreated. Accordingly, before the injection molding, insert molding, or overmolding step, the thermoset sole insert 28 preferably is coated with a heat activated adhesive as, for example, ACA 30-114 manufactured by Akron Coating & Adhesive, Inc. ACA 30-114 is a heat-activated water-borne adhesive having a saturated polyurethane with an epoxy resin derivative and adhesion promoter designed from non-polar adherents. It will be appreciated that other types of heat-activated adhesives also may be used.

After the coating step, the coated thermoset sole insert is then placed in a mold and the thermoplastic composite weight track material is overmolded (or injection molded) over the sole insert as described above. During the injection molding step, heat activates the adhesive coating on the sole insert to promote bonding between the sole insert and the weight track material.

Notably, though not necessary, the alternative thermoplastic composite sole insert made using a thermoforming process, as described above, also may be coated with a heat-activated adhesive prior to the overmolding step to promote an even stronger bond with the main body, notwithstanding that the thermoplastic sole insert and weight track thermoplastic material already are compatible for bonding if they have common or at least complementary matrices.

If the crown insert is made from a thermoset material and process, there is no need to coat the crown insert because no thermoplastic material is overmolded to the crown insert in the exemplary embodiments described herein. In the event additional thermoplastic features or 3-D details are overmolded on the crown insert, the same bonding principles discussed with respect to the weight track and sole insert apply.

Once the sole insert unit (sole insert 28 and weight track 30) and crown insert 26 are formed, they are joined to the frame 24 in a manner that creates a strong integrated construction adapted to withstand normal stress, loading and wear and tear expected of commercial golf clubs. For example, the sole insert unit and crown insert each may be bonded to the frame using epoxy adhesive, with the crown insert seated in and overlying the crown opening and the sole insert unit seated in and overlying the sole opening. Alternative attachment methods include bolts, rivets, snap fit, adhesives, other known joining methods or any combination thereof.

FIG. 3 is a bottom plan view of the sole of the club head, including the fore-aft weight track 30 and lateral (or toe-heel) weight track 36. The weight track 30 preferably has a recess, which may be generally rectangular in shape, to provide a recessed track to seat and guide the weight 32 as it adjustably slides fore and aft. Within the recess, the weight track 30 includes a peripheral rail or ledge 46 to define an elongate central opening or channel 48 preferably having a width dimension less than the width of the weight 32. In this way, when the weight 32 is seated flat against the ledge 46, the weight can slide forward and rearward in the weight track while the size and shape of the weight elements 32*a*, 32*b* prevent either one from passing through the channel 48 to the opposite side. At the same time, the channel permits the screw 34 to pass through the center of the weight element 32*b*, through the channel, and then into threaded engagement with the weight element 32*a* (not shown in FIG. 3). The ledge 46 and channel 48 serve to provide tracks or rails on which the joined weight elements 32*a*, 32*b* freely slide while effectively preventing the weight elements from inadvertently slipping through the channel.

FIG. 3 also shows that the weight 41 slideably mounted in the lateral weight track 36 is mounted in the same way as the fore-aft weight 32. Like the weight track 30, the lateral weight track 36 includes a peripheral rail or ledge 49 which defines a channel 50, and slideably mounts the lateral weight 41 for toeward and heelward sliding movement along the weight track. A screw 40*c* attaches the outer weight element shown in FIG. 3 to a companion weight element (hidden) on the other side of the ledge (or rail) 49. In the embodiment shown, the weight element 41 can be adjusted by loosening the screw 40*c* and moving the weight all the way to the toe end of the track, all the way to the heel end of the track, to a neutral position in the middle, or to other locations therebetween. If a second or third weight is added to the weight track, many additional weight location options are available for additional fine tuning of the head's effective CG location in the heel-toe direction.

Figure 4:
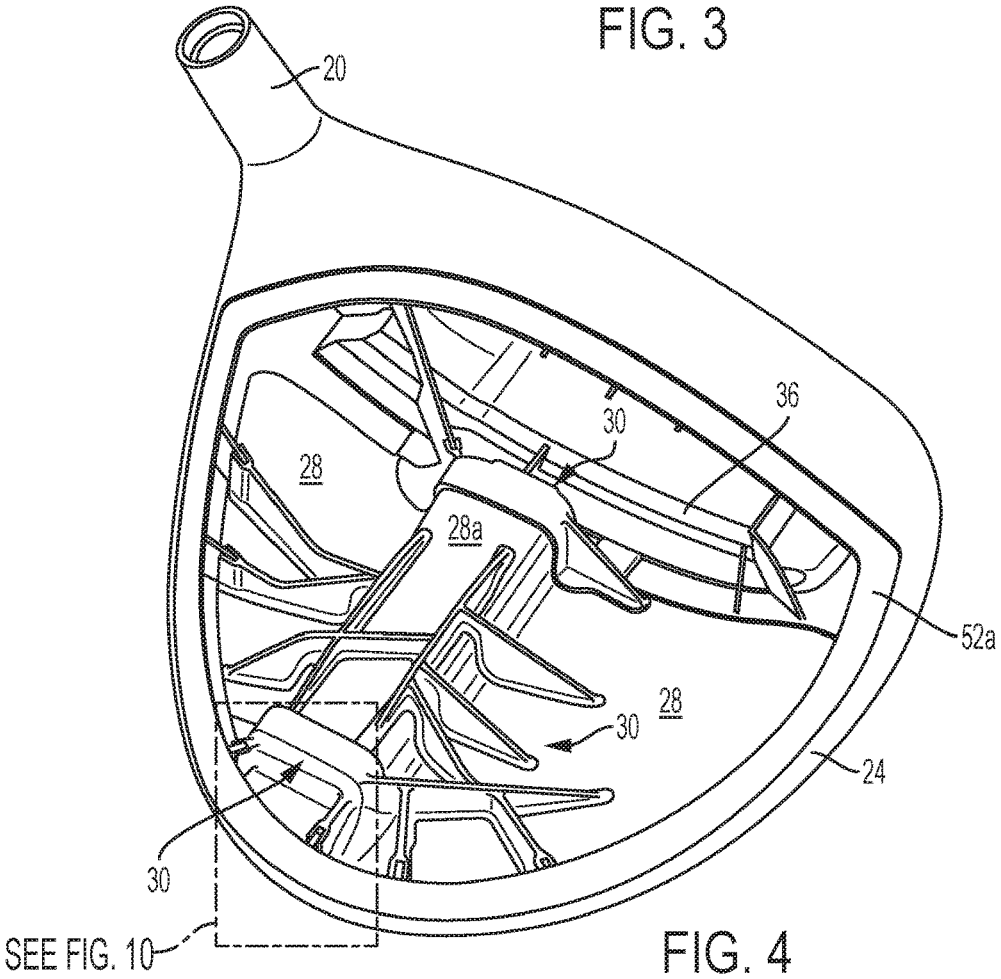
FIG. 4 is a top perspective view of the golf club head of FIG. 1 or FIG. 2 with a crown insert portion removed.

FIG. 4 shows the head with the crown insert 26 removed, and provides a view of the hollow interior of the head from the top. FIG. 4 illustrates how the weight track 30 includes internal ribs, supports and other features overmolded on the sole insert 28. For example, the weight track may include various supports wrapping over a central ridge 28*a* of the sole insert, fore-aft supporting ribs along the top of the ridge 28*a*, and lateral ribs extending outwardly from the central ridge 28. It can be seen that the overmolding process allows the weight track and other intricate features and details to be incorporated into the design of the head. For example, in addition to the performance benefits provided by the weight track, the various ribs and features shown in FIG. 4 can provide structural support and additional rigidity for the club head and also modify and even fine tune the acoustic properties of the club head. The sound and modal frequencies emitted by the club head when it strikes the ball are very important to the sensory experience of the golfer and provides functional feedback as to where the ball impact occurs on the face (and whether the ball is well struck).

FIG. 5 shows the sole insert 28, including its central rib or ridge 28*a*, before the weight track 30 has been overmolded thereto. The ridge 28*a* is centrally located on the sole insert and extends generally from front to back to provide additional structural support for the sole of the club head. The ridge 28*a* also provides an elongate weight recess or port on its outer surface within which to seat the fore-aft weight track 30. The sole insert may include a plurality of through holes 50 in various locations to provide a flow path for injection mold melt during the injection molding step and create a mechanical interlock between the sole insert 28 and overmolded weight track 30, thereby forming the sole insert unit.

FIG. 6 shows in greater detail the sole insert 28 with the overmolded weight track 30 joined thereto. It can be seen (especially in the context of the other figures) that the weight track 30 wraps around both sides (interior and exterior) of the sole insert. In addition to the channel 48 and peripheral ledge (or rail) 46 overmolded on the outer surface of the sole insert, the weight track 30 also preferably includes one or more ribs and other features on the interior surface of the sole insert. For example, FIG. 6 shows reinforcing supports 30*a*, 30*b* draped over opposite ends of the ridge 28*a*, parallel fore-aft extending ribs 30*c*, 30*d* tracking along the top of the ridge 28*a*, cross-rib 30*e* connecting the ribs 30*c*, 30*d*, and various lateral and other ribs 30*f*, 30*g*, 30*h*, 30*i*, 30*j*, 30*k*, 30*l*, 30*m*, 30*n*, 30*o*, 30*p*, and 30*q*, which are all interconnected to form a reinforcing network or matrix of supporting ribs and supports to reinforce the sole insert and club head.

Equally important, since the ribs are injection molded they can have a wide variety of shapes, sizes, orientations, and locations on the sole insert to adjust and fine tune acoustic properties of the club head. It can be seen in FIG. 6 that the rib network adds rigidity in both the lateral and longitudinal directions and thereby imparts strategically located stiffness to the club head. In this regard, some of the ribs, such as ribs 30*j*, 30*k*, 30*l*, 30*m*, 30*o*, 30*p*, and 30*q*, have forked ends to engage mating structural elements on the frame 24, thereby aligning the sole insert for attachment to the frame as well as providing a strong mechanical bond between the sole insert unit and frame. While the overmolded component of the illustrated embodiment is shown as a structure that provides a weight track to support a slidable weight, as well as reinforcing and acoustic elements, it will be appreciated that the overmolded component can take other forms to provide other 3-D features and functions.

FIG. 7 is a vertical cross-section view showing the hollow interior of the club head, as viewed from the aft end looking forward toward the face. The frame 24 preferably includes a recessed seat or ledge 52*a* extending around the crown opening to seat the crown insert 26. Similarly, the frame 24 includes a seat or ledge 52*b* around the sole opening to receive the sole insert 28. The weight elements 32*a*, 32*b* of the weight 32 are shown seated in their respective channels and separated by rail 46. Weight elements 32*a*, 32*b* are shown having aligned bores to receive the screw 34 (FIGS. 1, 2). The bore of the weight element 32*a* is threaded such that loosening of the screw 34 separates the weight elements to allow sliding movement fore and aft within the weight track, while tightening the screw pulls the weights together into locking engagement with the rail 46 to prevent sliding movement during play on the golf course.

FIG. 7 also illustrates how the lateral weight track 36 spans the front of the club head sole in proximity to a lower end of the face plate 42.

FIG. 7 further illustrates how two of the ribs 30*p*, 30*q* having forked (or channeled) ends to securely engage respective ends of reinforcing flanges (or ribs) 54*a*, 54*b*. The flanges 54*a*, 54*b* and others not shown may be integrally formed as part of the frame 24. It will be appreciated that the other thermoplastic weight track ribs having forked ends similarly interlock with other ribs formed as part of the frame 24.

FIG. 8 is a vertical cross-section showing the interior of the hollow club head from another perspective, and looking generally from the heel side toward the toe side. The figure illustrates how the fore-aft weight track 30 and a two-piece weight 32 (with weight elements 32*a*, 32*b*) is very similar to the lateral weight track 36 and two-piece weight 41 (which includes weight elements 41*a*, 41*b*). Unlike the weight track 30, however, in the exemplary embodiment shown the weight track 36, which includes parallel rails or ledges 56*a*, 56*b*, are formed as an integral part of the frame 24. Alternatively, the weight track 36 may be formed as a component which is injection molded over an elongate recessed channel or port formed within the frame 24, much like weight track 30. The manner in which the weight 41 is tightened, loosened and slidably adjusted is as described above in connection with the weight track 30.

Figure 9:
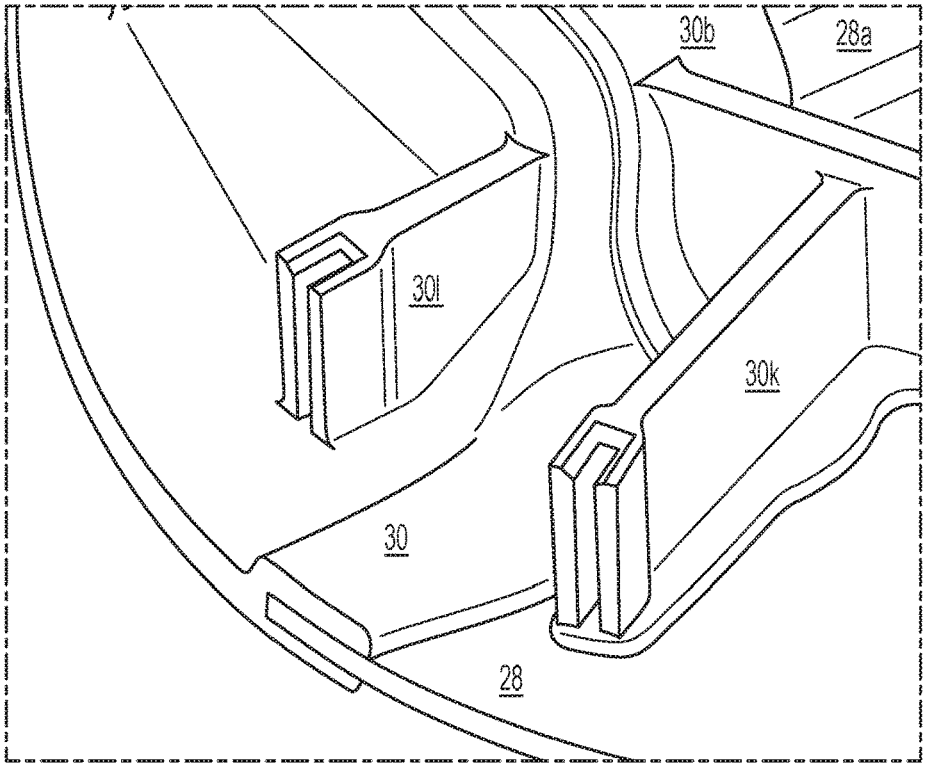
FIG. 9 is an enlarged view of a portion of FIG. 6.
Figure 10:
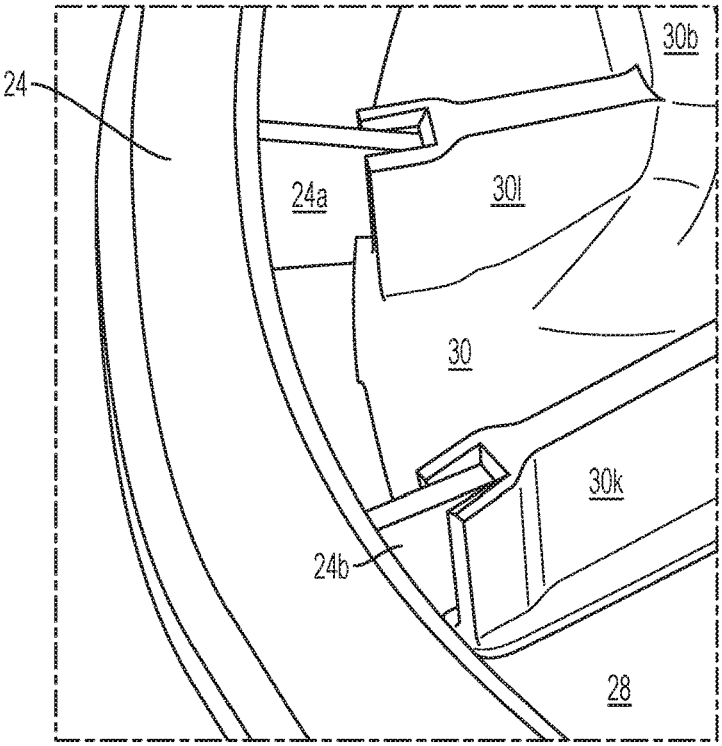
FIG. 10 is an enlarged view of a portion of FIG. 4 and viewed from a slightly different perspective.

FIG. 9 is an enlarged portion of FIG. 6 showing in greater detail one of the seams, joints or interface sections where the sole insert 28 and weight track 30 are joined. Support portion 30*b* is shown supportively draped over one end of the ridge 28*a* of the sole insert 28. The forked ends of the ribs 30*l*, 30*k* form channels ready to receive respective ends of flanges or ribs joined to the frame 24. These flanges or ribs are designated as 24*a*, 24*b* in FIG. 10, which is an enlarged view of a portion of FIG. 4. Unlike FIG. 9, FIG. 10 shows the frame 24 and illustrates how ribs 30*l*, 30*k* mate with the ends of respective flanges 24*a*, 24*b*.

The composite sole and weight track disclosed in various embodiments herein overcome manufacturing challenges associated with conventional club heads having titanium or other metal weight tracks, and replace a relatively heavy weight track with a light composite material (freeing up discretionary mass which can be strategically allocated elsewhere within the club head). For example, additional ribs can be strategically added to the hollow interior of the club head and thereby improve the acoustic properties of the head. Ribs can be strategically located to strengthen or add rigidity to select locations in the interior of the head. Discretionary mass in the form of ribs or other features also can be strategically located in the interior to shift the effective CG fore or aft, toeward or heelward or both (apart from any further CG adjustments made possible by slidable weight features).

Also, embodiments described herein having continuous fiber composite sole and crown inserts are especially effective in providing improved structural support and stiffness to the club head, as well as freeing up discretionary mass that can be allocated elsewhere.

In the embodiment shown in FIGS. 11-16, the head 100 has a forward face area 242, and a main body or frame 224, a crown insert 226 and sole insert 228, both inserts made from a composite material, a weight track 236, and a hosel 222. The weight track 236 is located in the frame in the sole of the club head and defines a track for mounting a two-piece slidable weight 241, which may be fastened to the weight track by a fastening means such as a screw 240. The weight 241 can take forms other than as shown and can be mounted in other ways, and can take the form of a single piece design or multi-piece design (such as a two-piece design having weight elements 32*a*, 32*b* as shown in FIG. 2). The weight track allows the weight 241 to be slidably adjusted along the track and then tightened in place to adjust the effective CG and MOI of the club head as desired by the user. Further adjustment is also obtained by the location of additional weighting towards of the club head by location of additional movable weight 262 in the rear of the frame of the clubhead. Thus varying the relative magnitude of the slidably adjusted weight 236 and the rearward weight 262 allows for further adjustment of the club head's CG forward or rearward and the performance characteristics of the club head to affect the flight of the golf ball, especially spin characteristics of the golf ball. In some embodiments the fastening system of the slidably adjusted weight 236 and the rearward weight 262 will utilize the same threaded screw 240 facilitating the user ability to swap the weights using the same tool to achieve the desired performance.

Figure 13:
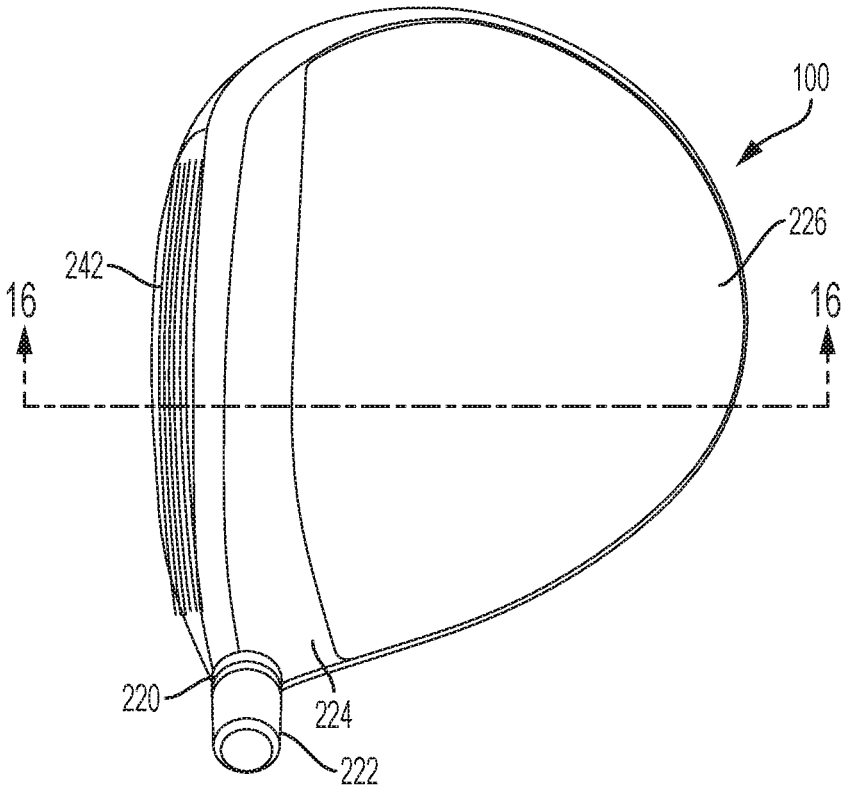
FIG. 13 is a top view of a golf club head of the present invention.
Figure 14:
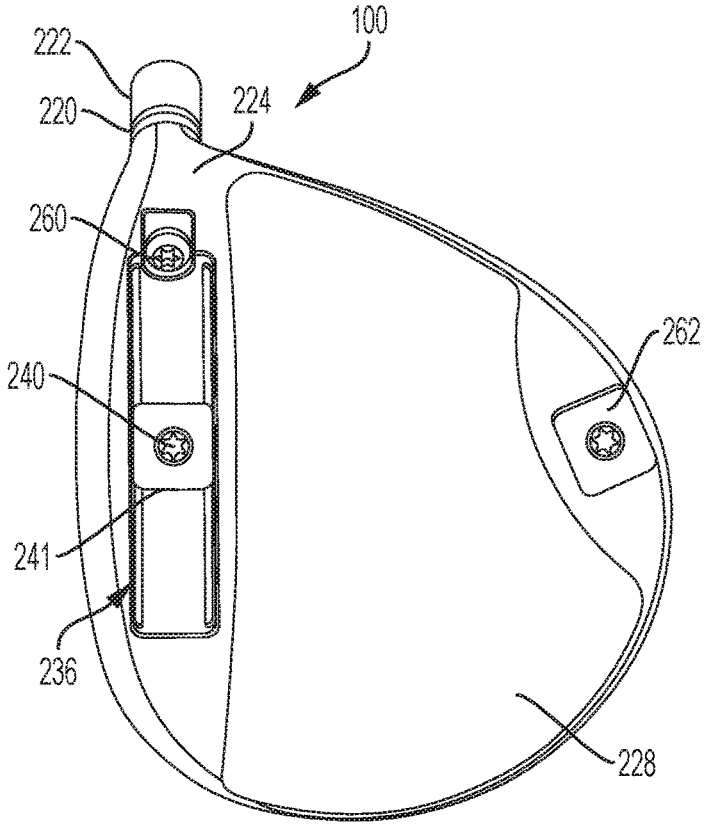
FIG. 14 is a bottom view of a golf club head of the present invention.
Figure 15:
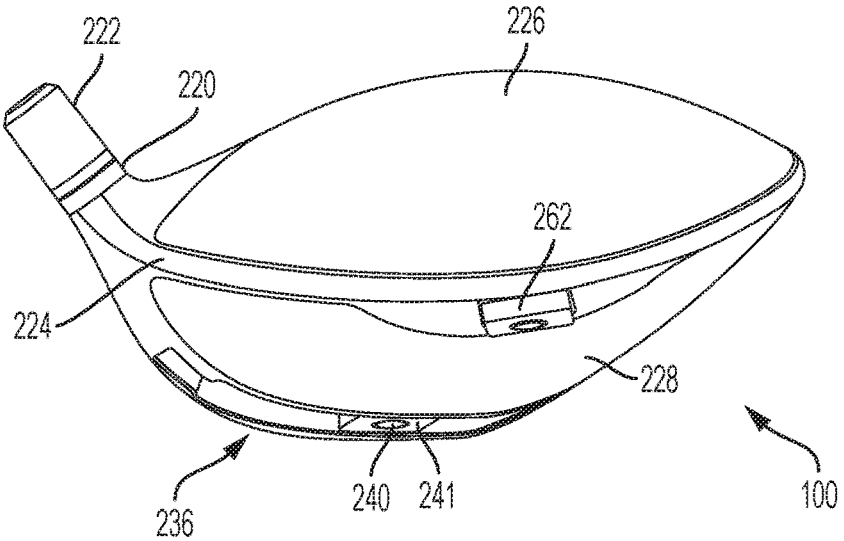
FIG. 15 is side view a golf club head of the present invention showing the positioning of a rear fixed weight and sliding front weight.
Figure 16:
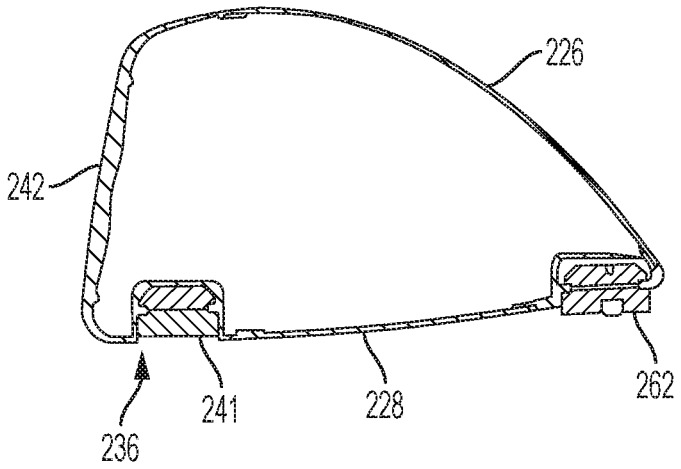
FIG. 16 vertical cross section taken generally along line 16-16 of FIG. 13.

As shown in FIG. 13 and the cross sectional view in FIG. 16, the frame 224 preferably has a lower sole opening sized and configured to receive the composite sole insert 228, and an upper crown opening sized and configured to receive the composite crown insert 226. More specifically, the sole opening receives a sole insert unit including the sole insert 228. The sole and crown openings are each formed to have a peripheral edge or recess to seat, respectively, the sole insert unit 228 and crown insert 226, such that the sole and crown inserts are either flush with the frame 224 to provide a smooth seamless outer surface or, alternatively, slightly recessed.

Figure 11:
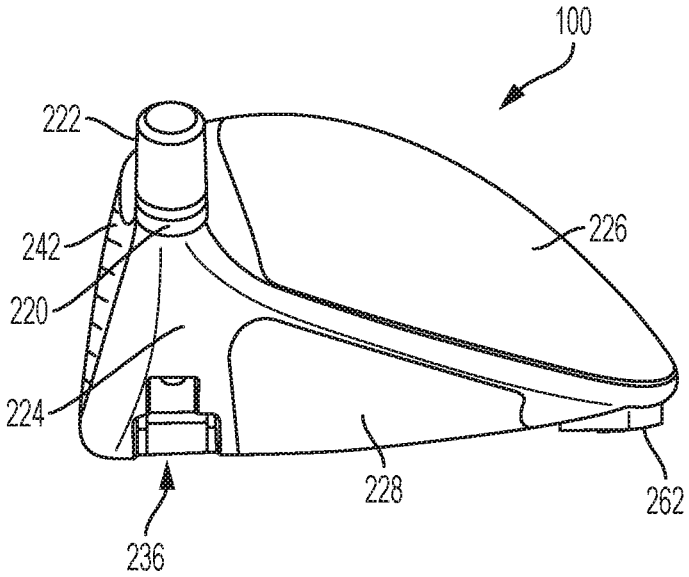
FIG. 11 is a side view of another embodiment golf club head of the present invention.
Figure 12:
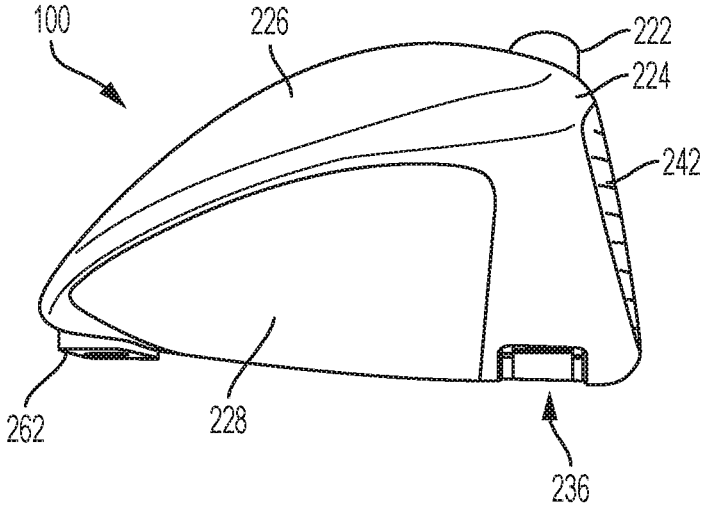
FIG. 12 is the opposite side view of the golf club head of FIG. 11.

Though not shown, the frame 224 preferably has a face opening to receive a face plate or strike plate 242 that is attached to the frame by welding, braising, soldering, screws or other fastening means. FIG. 11 and the other figures generally show the face plate already joined to the frame.

Figure 17:
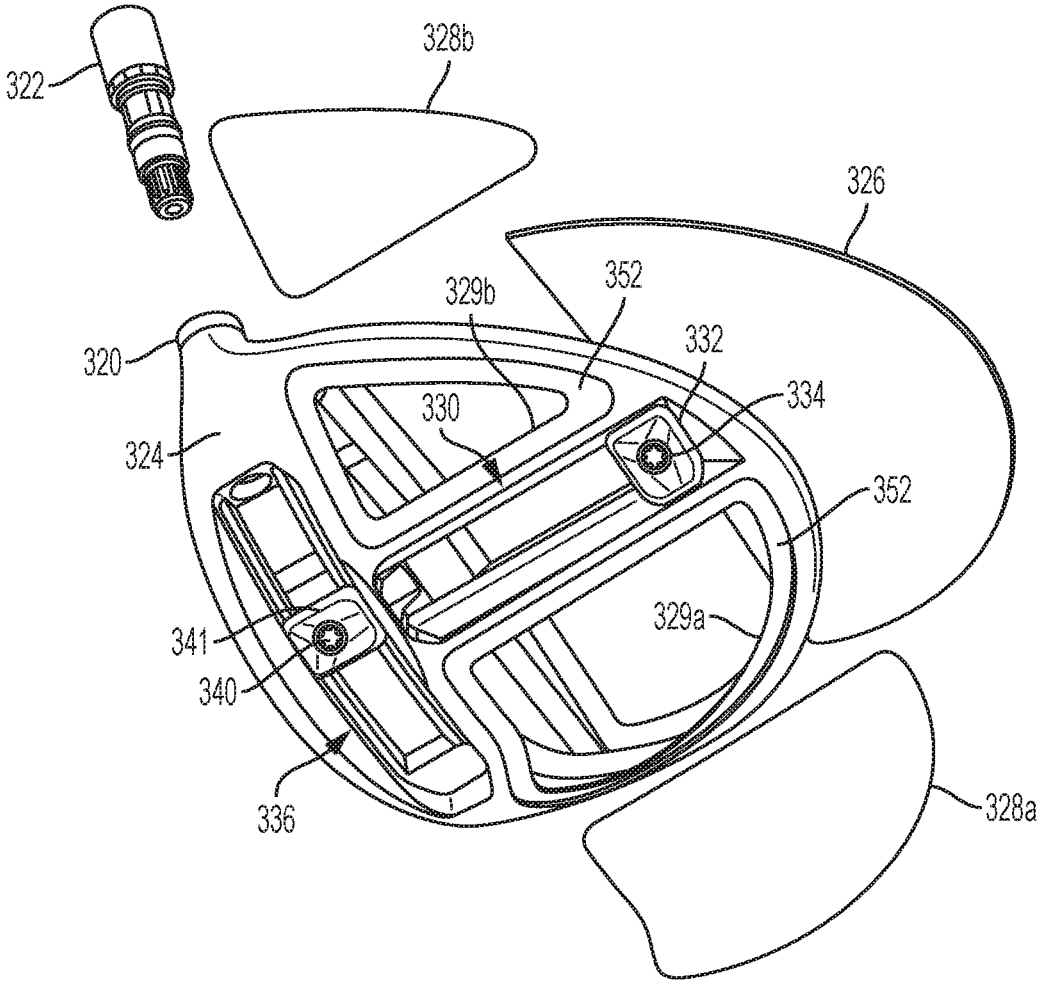
FIG. 17 is an exploded bottom view of another embodiment golf club head of the present invention.
Figure 18:
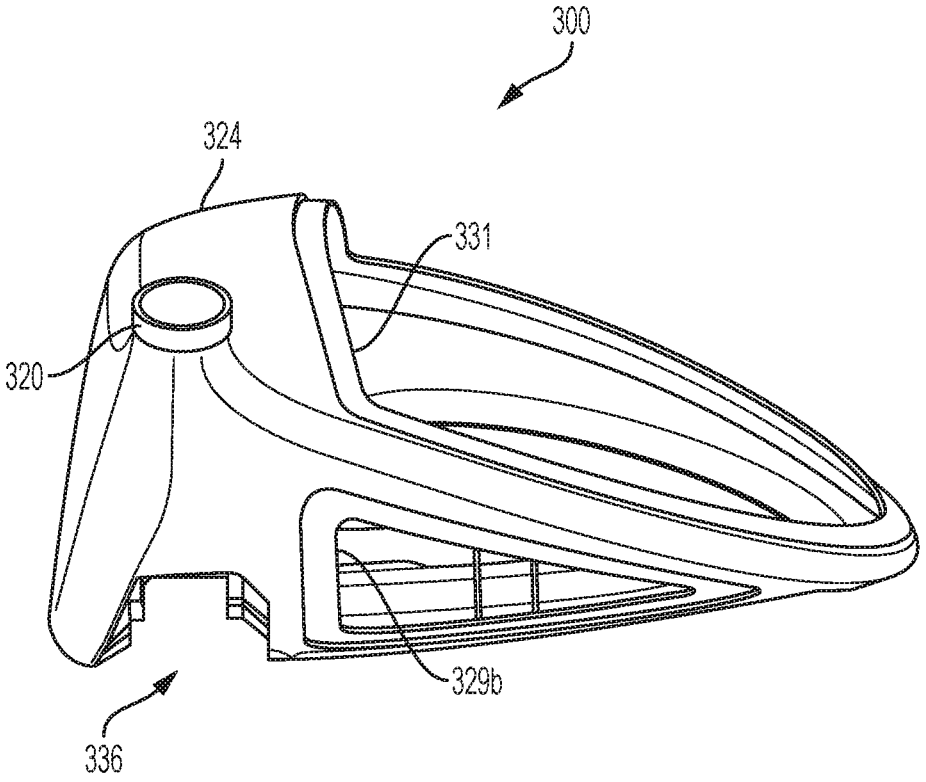
FIG. 18 is a side view of a golf club head of the present invention.
Figure 19:
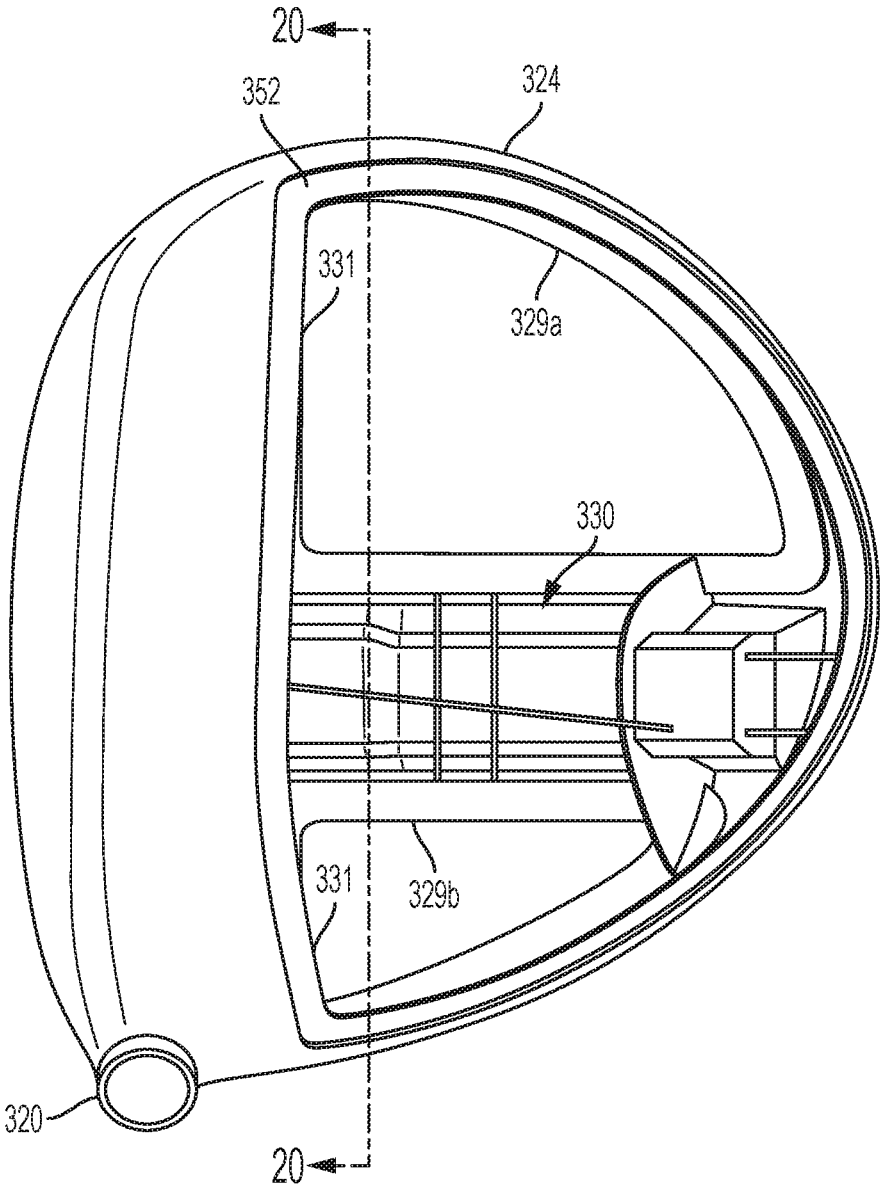
FIG. 19 is a top view of a golf club head of the present invention with the top panel removed.

FIGS. 17-20, show another embodiment of the golf clubhead of the present invention. FIG. 17 is an exploded view of various components of the club head 300. The club head may include a main body or frame 324, crown insert 326, and two sole sole inserts 328*a* and 328*b*, weight track 330, and FCT component 322. The weight track 330 is located in the sole of the club head and defines a track for mounting a two-piece slidable weight 332, which may be fastened to the weight track by a fastening means such as a screw 334. The weight 332 can take forms other than as shown in FIG. 17, can be mounted in other ways, and can take the form of a single piece design or multi-piece design (such as a dual weight design having weight elements 32*a*, 32*b* as shown in FIG. 2). The weight track allows the weight 332 to be loosened for slidable adjustment fore and aft along the track and then tightened in place to adjust the effective CG of the club head in the front to rear direction. By shifting the club head's CG forward or rearward, the performance characteristics of the club head can be modified to affect the flight of the golf ball, especially spin characteristics of the golf ball.

The sole of the frame 324 preferably is integrally formed with a lateral weight track 336, which extends generally parallel to and near the face of the club head and generally perpendicular to the weight track 330. The lateral weight track 336 defines a track or port for mounting (in one exemplary embodiment) one or more slidable weights that are fastened to the weight track. In the present embodiment the lateral weight track 336 slideably mounts only on one lateral weight 341. The weight 341 may comprise a single weight element, multiple weight elements or two stacked weight elements fastened together by a screw 340.

The lateral weight track of FIG. 17 allows the weights 341 to be loosened for slidable adjustment laterally in the heel-toe direction and then tightened in place to adjust the CG of the club head in the heel-toe direction. This is accomplished by loosening screw 340, adjusting the weight and then tightening the screws 340. By adjusting the CG heelward or toeward, the performance characteristics of the club head can be modified to affect the flight of the ball, especially the ball's tendency to draw or fade, or to counter the ball's tendency to slice or hook.

Figure 20:
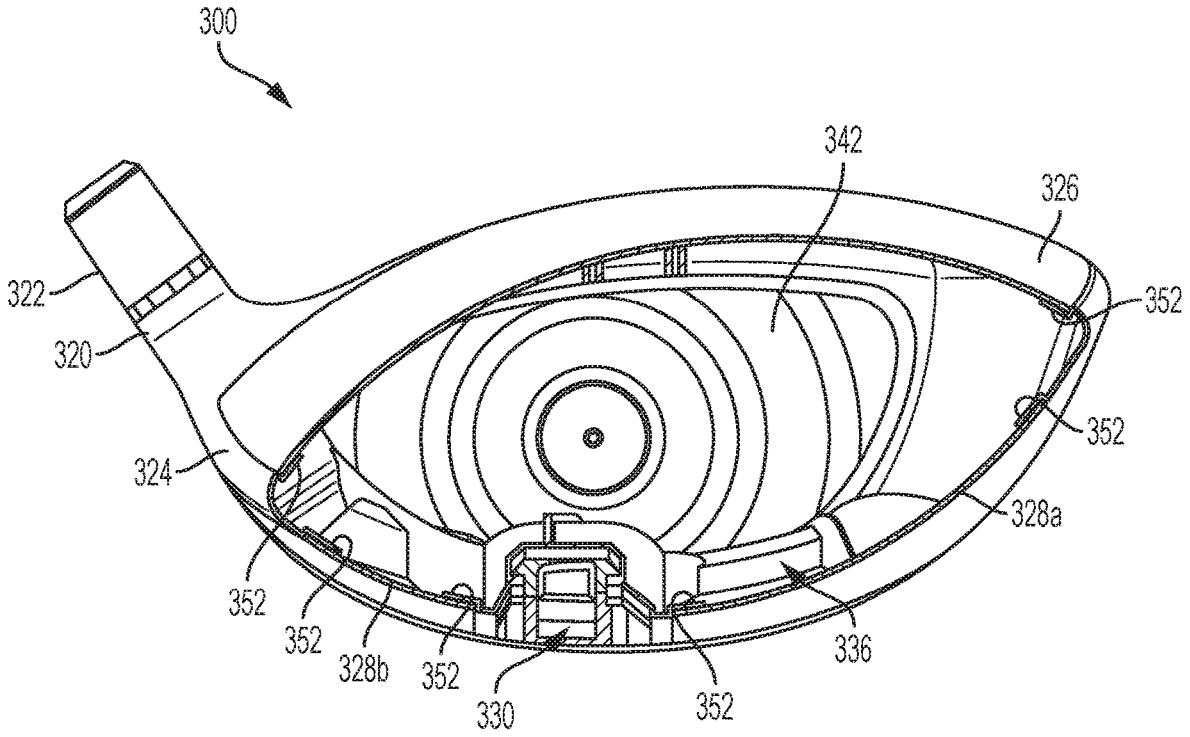
FIG. 20 is a rear view of a golf club head of the present invention with the face removed.

The frame 324 preferably has two lower sole openings 329 *a* and 329*b* sized and configured to receive the sole inserts 328*a* and 328*b* respectively, and an upper crown opening 331 sized and configured to receive the crown insert 326. The sole and crown openings are each formed to have a peripheral edges or recess 352 as shown in FIG. 20 to seat, respectively, the sole insert units 328*a* and 328*b*, such that the sole and crown inserts are either flush with the frame 324 to provide a smooth seamless outer surface or, alternatively, slightly recessed.

Though not shown, the frame 324 preferably has a face opening to receive a face plate or strike plate 342 that is attached to the frame by welding, braising, soldering, screws or other fastening means.

In the golf club heads of the present invention, the ability to adjust the relative magnitude of the slidably adjusted weights and rearward weights coupled with the weight saving achieved by incorporation of the composite sole and crown inserts allows for a large range of variation of a number properties of the club-head all of which affect the ultimate club-head performance including both the position of the CG of the club-head and its various MOI values.

Generally, the center of gravity (CG) of a golf club head is the average location of the weight of the golf club head or the point at which the entire weight of the golf club-head may be considered as concentrated so that if supported at this point the head would remain in equilibrium in any position. A club head origin coordinate system can be defined such that the location of various features of the club head, including the CG can be determined with respect to a club head origin positioned at the geometric center of the striking surface and when the club-head is at the normal address position (i.e., the club-head position wherein a vector normal to the club face substantially lies in a first vertical plane perpendicular to the ground plane, the centerline axis of the club shaft substantially lies in a second substantially vertical plane, and the first vertical plane and the second substantially vertical plane substantially perpendicularly intersect).

The head origin coordinate system defined with respect to the head origin includes three axes: a z-axis extending through the head origin in a generally vertical direction relative to the ground; an x-axis extending through the head origin in a toe-to-heel direction generally parallel to the striking surface (e.g., generally tangential to the striking surface at the center) and generally perpendicular to the z-axis; and a y-axis extending through the head origin in a front-to-back direction and generally perpendicular to the x-axis and to the z-axis. The x-axis and the y-axis both extend in generally horizontal directions relative to the ground when the club head is at the normal address position. The x-axis extends in a positive direction from the origin towards the heel of the club head. The y axis extends in a positive direction from the head origin towards the rear portion of the club head. The z-axis extends in a positive direction from the origin towards the crown. Thus for example, and using millimeters as the unit of measure, a CG that is located 3.2 mm from the head origin toward the toe of the club head along the x-axis, 36.7 mm from the head origin toward the rear of the clubhead along the y-axis, and 4.1 mm from the head origin toward the sole of the club head along the z-axis can be defined as having a $CG_x$ of −3.2 mm, a $CG_y$ of −36.7 mm, and a $CG_z$ of −4.1 mm.

Further as used herein, Delta 1 is a measure of how far rearward in the club head body the CG is located. More specifically, Delta 1 is the distance between the CG and the hosel axis along the y axis (in the direction straight toward the back of the body of the golf club face from the geometric center of the striking face). It has been observed that smaller values of Delta 1 result in lower projected CGs on the club head face. Thus, for embodiments of the disclosed golf club heads in which the projected CG on the ball striking club face is lower than the geometric center, reducing Delta 1 can lower the projected CG and increase the distance between the geometric center and the projected CG. Recall also that a lower projected CG creates a higher dynamic loft and more reduction in backspin due to the z-axis gear effect. Thus, for particular embodiments of the disclosed golf club heads, in some cases the Delta 1 values are relatively low, thereby reducing the amount of backspin on the golf ball helping the golf ball obtain the desired high launch, low spin trajectory.

Similarly Delta 2 is the distance between the CG and the hosel axis along the x axis (in the direction straight toward the back of the body of the golf club face from the geometric center of the striking face).

Adjusting the location of the discretionary mass in a golf club head as described above can provide the desired Delta 1 value. For instance, Delta 1 can be manipulated by varying the mass in front of the CG (closer to the face) with respect to the mass behind the CG. That is, by increasing the mass behind the CG with respect to the mass in front of the CG, Delta 1 can be increased. In a similar manner, by increasing the mass in front of the CG with the respect to the mass behind the CG, Delta 1 can be decreased.

In addition to the position of the CG of a club-head with respect to the head origin another important property of a golf club-head is a projected CG point on the golf club head striking surface which is the point on the striking surface that intersects with a line that is normal to the tangent line of the ball striking club face and that passes through the CG. This projected CG point ("CG Proj") can also be referred to as the "zero-torque" point because it indicates the point on the ball striking club face that is centered with the CG. Thus, if a golf ball makes contact with the club face at the projected CG point, the golf club head will not twist about any axis of rotation since no torque is produced by the impact of the golf ball. A negative number for this property indicates that the projected CG point is below the geometric center of the face.

In terms of the MOI of the club-head (i.e., a resistance to twisting) it is typically measured about each of the three main axes of a club-head with the CG as the origin of the coordinate system. These three axes include a CG z-axis extending through the CG in a generally vertical direction relative to the ground when the club head is at normal address position; a CG x-axis extending through the CG origin in a toe-to-heel direction generally parallel to the striking surface (e.g., generally tangential to the striking surface at the club face center), and generally perpendicular to the CG z-axis; and a CG y-axis extending through the CG origin in a front-to-back direction and generally perpendicular to the CG x-axis and to the CG z-axis. The CG x-axis and the CG y-axis both extend in generally horizontal directions relative to the ground when the club head is at normal address position. The CG x-axis extends in a positive direction from the CG origin to the heel of the club head. The CG y-axis extends in a positive direction from the CG origin towards the rear portion of the golf club head. The CG z-axis extends in a positive direction from the CG origin 150 towards the crown 112. Thus, the axes of the CG origin coordinate system are parallel to corresponding axes of the head origin coordinate system. In particular, the CG z-axis is parallel to z-axis, the CG x-axis is parallel to x-axis, and CG y-axis is parallel to y-axis.

Specifically, a club head as a moment of inertia about the vertical axis ("Izz"), a moment of inertia about the heel/toe axis ("Ixx"), and a moment of inertia about the front/back axis ("Iyy"). Typically, however, the MOI about the z-axis (Izz) and the x-axis (Ixx) is most relevant to club head forgiveness.

A moment of inertia about the golf club head CG x-axis (Ixx) is calculated by the following equation:

$$Ixx=\int(y^2+z^2)dm \quad (1)$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis and the golf club head CG z-axis. The CG xy-plane is a plane defined by the golf club head CGx-axis and the golf club head CG y-axis.

Similarly, a moment of inertia about the golf club head CG z-axis (Izz) is calculated by the following equation:

$$Izz=\int(x^2+y^2)dm \quad (2)$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG y-axis and the golf club head CG z-axis.

A further description of the coordinate systems for determining CG positions and MOI can be found US Patent Publication No. 2012/0172146 A1 publishing on Jul. 5, 2012, the entire contents of which is incorporated by reference herein.

As shown in Table 1 below, the clubs of the present invention are able to achieve extremely high ranges of CGx, CGz, Delta 1 and Delta 2 and Ixx, Izz and projected CG position "BP" within the adjustability ranges of the club head. The values measured in Table 1 where obtained for a club-head having a volume of 452 cm3 when measured with an open front track and varying the distribution of the total discretionary weight as represented by the total; weight of the slidably adjusted weight 236 and the rearward weight 262 (which in the below example totals 44 g) by distributing it between the "front position i.e. the center point of the weight track 236 and the back position ie the location of the weight port of rearward weight 262.

TABLE 1

| Front Mass (g) | Back Mass (g) | CGx (mm) | CGz (mm) | Delta 1 (mm) | Delta 2 (mm) | Final Club-Head Mass (g) | $I_{XX}$ (kg-mm$^2$) | $I_{ZZ}$ (kg-mm$^2$) | CG Proj (mm) |
|---|---|---|---|---|---|---|---|---|---|
| 44 | 0 | 0.41 | −5.89 | 9.6 | 32.9 | 205.1 | 225 | 347 | −1.5 |
| 39.8 | 4.1 | 0.22 | −5.78 | 11.3 | 33.1 | 205 | 248 | 372 | −1.1 |
| 35.1 | 9.1 | 0 | −5.66 | 13.4 | 33.4 | 205.3 | 274 | 399 | −0.6 |
| 30 | 14 | −0.24 | −5.52 | 15.5 | 33.7 | 205.1 | 299 | 425 | −0.1 |
| 24.9 | 19 | −0.46 | −5.37 | 17.6 | 33.9 | 205 | 321 | 449 | 0.4 |
| 20.1 | 24 | −0.69 | −5.25 | 19.6 | 34.2 | 205.2 | 342 | 471 | 0.9 |
| 15 | 29 | −0.92 | −5.1 | 21.7 | 34.5 | 205 | 361 | 492 | 1.4 |
| 9.9 | 34.4 | −1.17 | −4.99 | 24 | 34.7 | 205.3 | 380 | 512 | 1.9 |

TABLE 1-continued

| Front Mass (g) | Back Mass (g) | CGx (mm) | CGz (mm) | Delta 1 (mm) | Delta 2 (mm) | Final Club-Head Mass (g) | $I_{XX}$ (kg-mm$^2$) | $I_{ZZ}$ (kg-mm$^2$) | CG Proj (mm) |
|---|---|---|---|---|---|---|---|---|---|
| 4.9 | 39.3 | −1.4 | −4.85 | 26 | 35 | 205.3 | 396 | 528 | 2.4 |
| 0 | 44.2 | −1.62 | −4.71 | 28.1 | 35.3 | 205.4 | 409 | 543 | 2.9 |

The overmolded thermoplastic component described herein, exemplified by the weight track and ribs/support matrix incorporated into the weight track, illustrates the possibilities for adding design complexities and intricacies to the sole and crown portions of the club head, by overmolding or injection molding 3-dimensional or other features while integrating large composite portions of the head with metal portions. In addition to the one or more weight tracks, and support members and ribs described herein, incorporation of other features may also be facilitated to differing degrees by their overmolding or injection molding over a composite laminate sole and/or crown insert or, alternatively, over a composite laminate shell forming the crown, sole and/or skirt of the club head, as described herein, such features including;

1. movable weight features including those described in more detail in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference in their entirety herein;
2. slidable weight features including those described in more detail in U.S. Pat. Nos. 7,775,905 and 8,444,505, U.S. patent application Ser. No. 13/898,313 filed on May 20, 2013, U.S. patent application Ser. No. 14/047,880 filed on Oct. 7, 2013, the entire contents of each of which are hereby incorporated by reference herein in their entirety;
3. aerodynamic shape features including those described in more detail in U.S. Patent Publication No. 2013/0123040A1, the entire contents of which are incorporated by reference herein in their entirety;
4. removable shaft features including those described in more detail in U.S. Pat. No. 8,303,431, the contents of which are incorporated by reference herein in their entirety;
5. adjustable loft/lie features including those described in more detail in U.S. Pat. Nos. 8,025,587, 8,235,831, 8,337,319, U.S. Patent Publication No. 2011/0312437A1, U.S. Patent Publication No. 2012/0258818A1, U.S. Patent Publication No. 2012/0122601A1, U.S. Patent Publication No. 2012/0071264A1, U.S. patent application Ser. No. 13/686,677, the entire contents of which are incorporated by reference herein in their entirety; and
6. adjustable sole features including those described in more detail in U.S. Pat. No. 8,337,319, U. S. Patent Publication Nos. US2011/0152000A1, US2011/0312437, US2012/0122601A1, and U.S. patent application Ser. No. 13/686,677, the entire contents of each of which are incorporated by reference herein in their entirety.

For example, as disclosed in U.S. Pat. No. 7,540,811 a golf club head may have a volume equal to the volumetric displacement of the club head body. In other words, for a golf club head with one or more weight ports within the head, it is assumed that the weight ports are either not present or are "covered" by regular, imaginary surfaces, such that the club head volume is not affected by the presence or absence of ports. A golf club head of the present application can be configured to have a head volume between about 110 $cm^3$ and about 600 $cm^3$. In more particular embodiments, the head volume is between about 250 $cm^3$ and about 500 $cm^3$. In yet more specific embodiments, the head volume is between about 300 $cm^3$ and about 500 $cm^3$, between 300 $cm^3$ and about 360 $cm^3$, between about 300 $cm^3$ and about 420 $cm^3$ or between about 420 $cm^3$ and about 500 $cm^3$.

Figure 21:
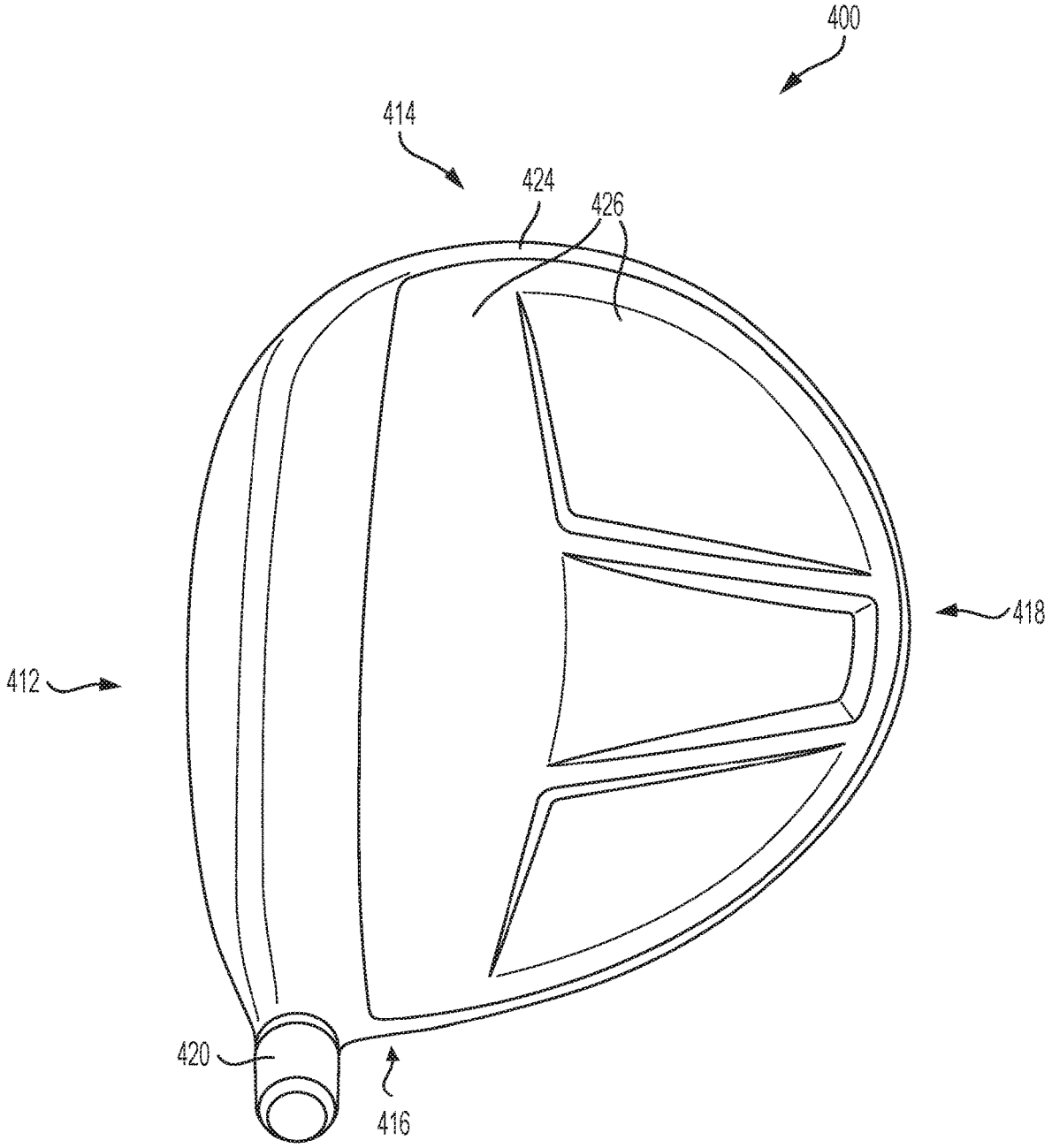
FIG. 21 is a top plan view of a golf club head in accordance with another embodiment.

The designs, embodiments and features described herein may also be combined with other features and technologies in the club-head including;

1. variable thickness face features described in more detail in U.S. patent application Ser. No. 12/006,060, U.S. Pat. Nos. 6,997,820, 6,800,038, and 6,824,475, which are incorporated herein by reference in their entirety;
2. composite face plate features described in more detail in U.S. patent application Ser. Nos. 11/998,435, 11/642,310, 11/825,138, 11/823,638, 12/004,386, 12/004,387, 11/960,609, 11/960,610 and U.S. Pat. No. 7,267,620, which are herein incorporated by reference in their entirety;

An additional embodiment of a golf club head 400 is shown in FIGS. 21-26. As shown in FIG. 21, the head 400 includes a forward face area 412, toe area 414, heel area 416 opposite the toe area 414, and a rear or aft area 418 opposite the forward face area 412. FIG. 21 also shows a downward looking view of the club head's upper surface or crown, and a hosel 420 to which a shaft may be attached directly (or alternatively to which a FCT component may be attached).

Figure 22:
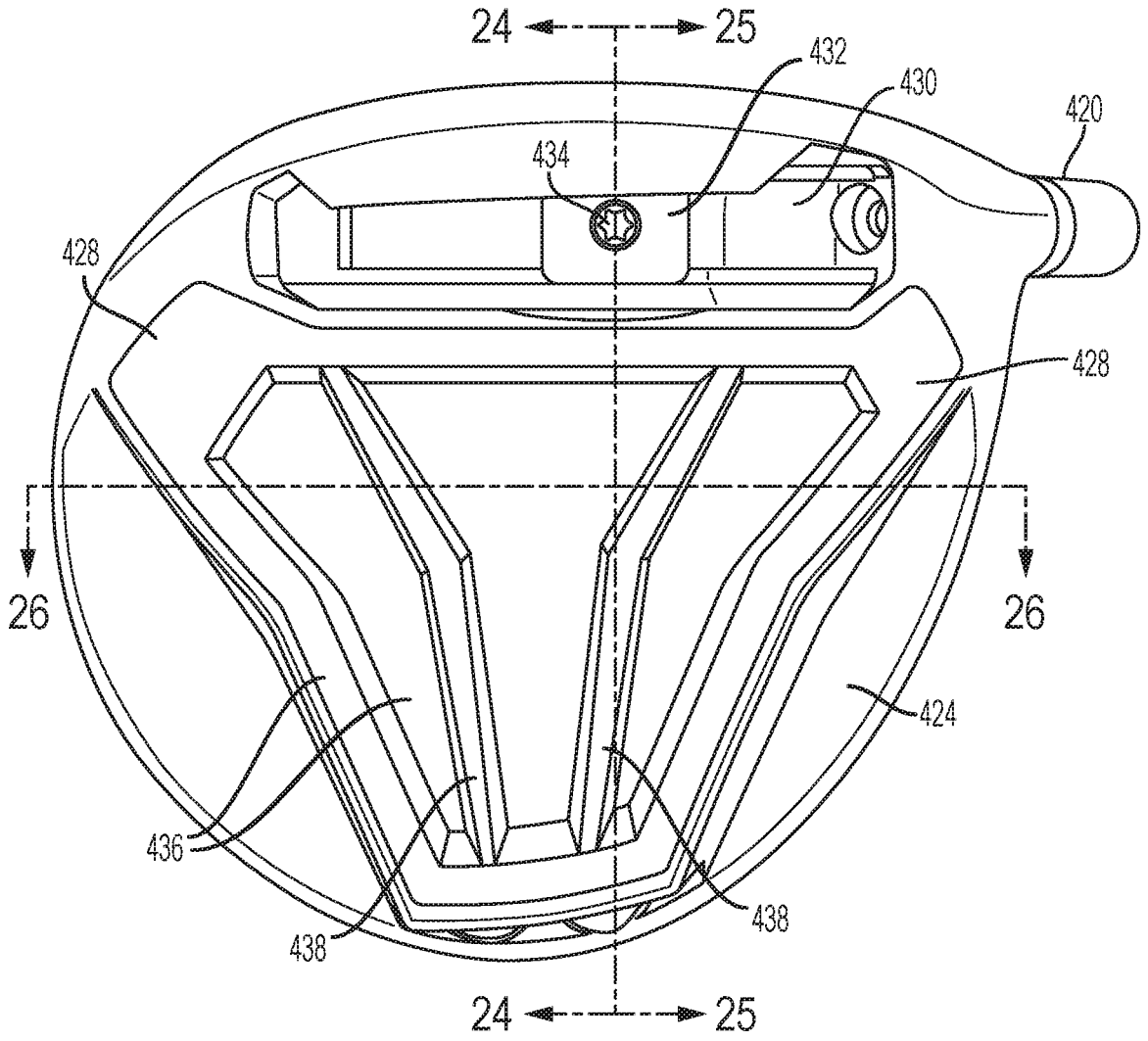
FIG. 22 is a bottom plan view of the golf club head of FIG. 21.

FIG. 22 is a bottom view of the club head's sole. The club head may include a main body or frame 424, crown insert 426 (FIG. 21), sole insert 428 and lateral weight track 430. As described above, the weight track 30 is located in the sole of the club and defines a track for mounting a two-piece slidable weight 432, which may be fastened to the weight track by a fastener such as a screw 434. The slidable weight can take other forms, such as a one-piece weight, and can be mounted in different ways. It also can be used to adjustably mount two or more slidable weights for more nuanced CG adjustments. The weight track allows the adjustable weight 432 to be loosened for adjustment laterally toward the toe or heel of the club and then tightened to adjust the effective CG of the club in the toe-heel direction. In so doing, the performance characteristics of the club can be adjusted to affect the flight of the golf ball, especially spin characteristics of the ball.

The lateral weight track 430 is very similar to the weight track discussed above. Like the weight track 36, the weight track 430 spans much of the width of the sole and allows the weight 432 to be positioned proximate to the toe of the club head at one end of the track or proximate to the heel (and hosel) at the other end of the track. Likewise, the lateral (or heel-toe) weight track also is located forward on the sole, proximate to the club head's ball-striking surface or face area 412. In modest contrast, the weight track 430 has enlarged ends at the toe side and heel side. The weight track 430 also connects with a heel-side shaft connection port used to provide a fastener opening for connecting a removable shaft and/or FCT component to the club head.

The frame 424 may be made from a variety of different types of materials but in one example is made of a metal material such as a titanium or titanium alloy (including but not limited to 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075). The frame may be formed by conventional casting, metal stamping or other known processes. The frame also may be made of other metals as well as non-metals. The frame provides a framework or skeleton for the club head to strengthen the club head in areas of high stress caused by the golf ball's impact with the face, such as the transition region where the club head transitions from the face to the crown area, sole area and skirt area located between the sole and crown areas.

In one exemplary embodiment, the sole insert 28 and/or crown insert 26 may be made from a variety of composite and polymeric materials, preferably from a thermoplastic material, more preferably from a thermoplastic composite laminate material, and most preferably from a thermoplastic carbon composite laminate material. For example, the composite material may be an injection moldable material, thermoformable material, thermoset composite material or other composite material suitable for golf club head applications. One exemplary material is a thermoplastic continuous carbon fiber composite laminate material having long, aligned carbon fibers in a PPS (polyphenylene sulfide) matrix or base. One commercial example of this type of material, which is manufactured in sheet form, is TEPEX® DYNALITE 207 manufactured by Lanxess.

Additional information regarding materials and properties suitable for the sole and crown inserts is discussed above.

As shown in FIG. 22, in one embodiment the sole insert 428 has a generally triangular shape with truncated corners, and preferably includes a recessed central area 436 and one or more ribs 438. The ribs 438, which may be located in the recessed area 436, serve to stiffen and reinforce the sole insert and thus the overall sole of the club head. In various embodiments, the sole insert covers at least about 20% of the surface area of the sole, at least about 30% of the surface area of the sole, at least about 40% of the surface area of the sole, or at least about 50% of the surface area of the sole. In another embodiment, the sole insert covers about 25 to 50% of the surface area of the sole. The sole insert contributes to a club head structure that is sufficiently strong and stiff to withstand the large dynamic loads imposed thereon, while remaining relatively lightweight to free up discretionary mass that can be allocated strategically elsewhere within the club head.

Figure 23:
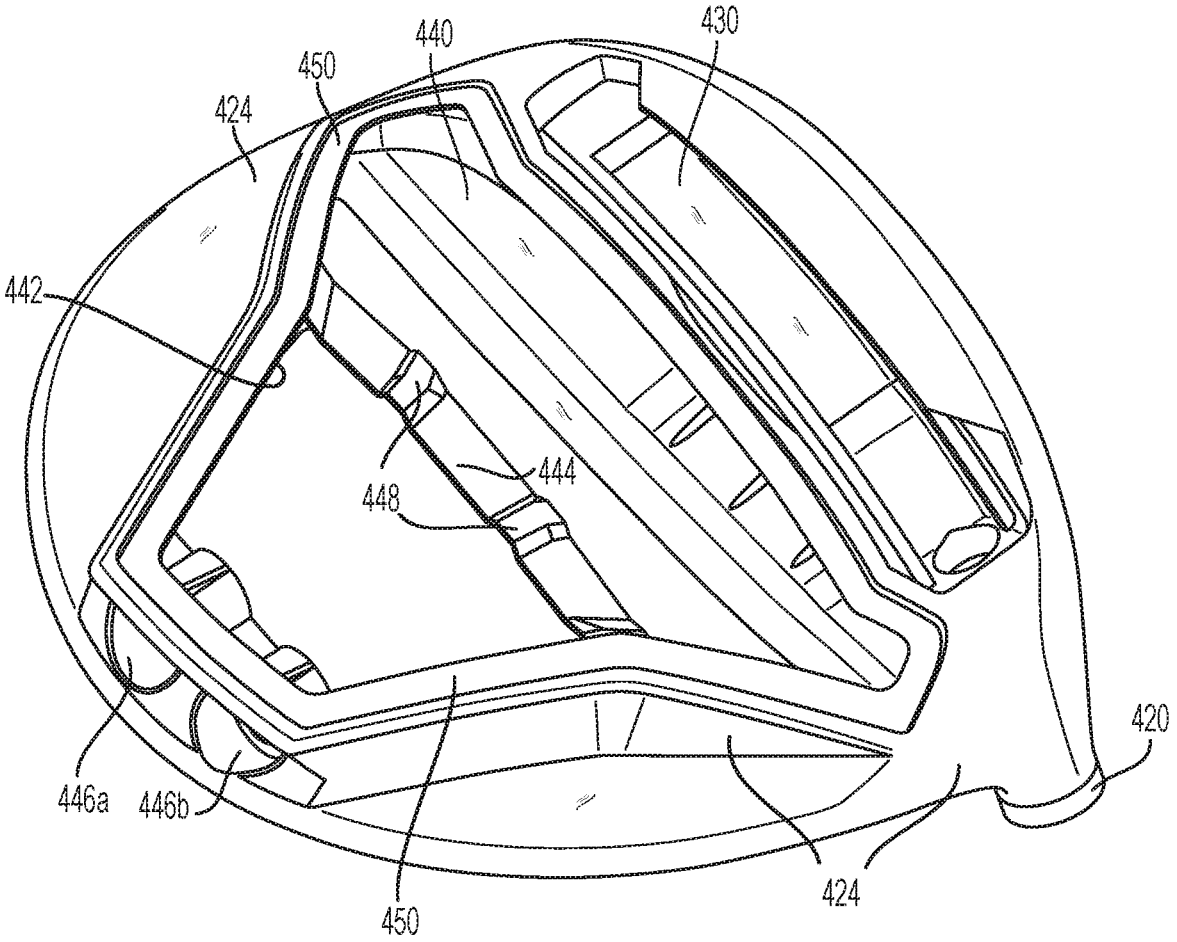
FIG. 23 is a perspective view of a sole portion of the embodiment of FIG. 21 with portions of the club head removed for purposes of illustration.

FIG. 23 is a perspective view of the club head's sole with the sole insert, crown insert and slidable weight removed. FIG. 23 shows the main body or frame 424, lateral weight track 430, hosel 420, and underside (interior surface) of a forward portion 440 of the club head's crown. It also shows in one exemplary embodiment an opening 442 in the sole to receive the sole insert, rib or tie rib 444 spanning the opening 442, and a pair of fixed weight ports **446*a*, 446*b* located at a rearmost portion of the sole. The weight ports 446*a*, 446*b* preferably are located centrally and proximate to one another, and proximate to and on opposite sides of a longitudinal center axis that generally bisects the club head into a toe half and a heel half. The weight ports 446*a*, 446*b* preferably are integrally formed as part of the main body 424**, but may be formed in other ways, for example, as inserts that are secured to the main body.

The tie rib 444 preferably extends in a generally lateral heel-toe direction and is positioned generally midway between fore and aft ends of the opening 442. The tie rib 444 preferably has one or more raised portions 448 along its length, with channels or recesses therebetween, to create an undulating profile that preferably mates or nests with a complementary profile in the underside (i.e., interior) surface of the sole insert 428. The sole insert 428 preferably is adhered to the tie rib 444 and to a complementary sized and shaped recessed shelf 450 extending along the periphery of the sole insert opening 442. The sole insert may be secured to the main body 424 in other ways including the use of fasteners or other bonding techniques besides adhesion mentioned above.

Figure 24:
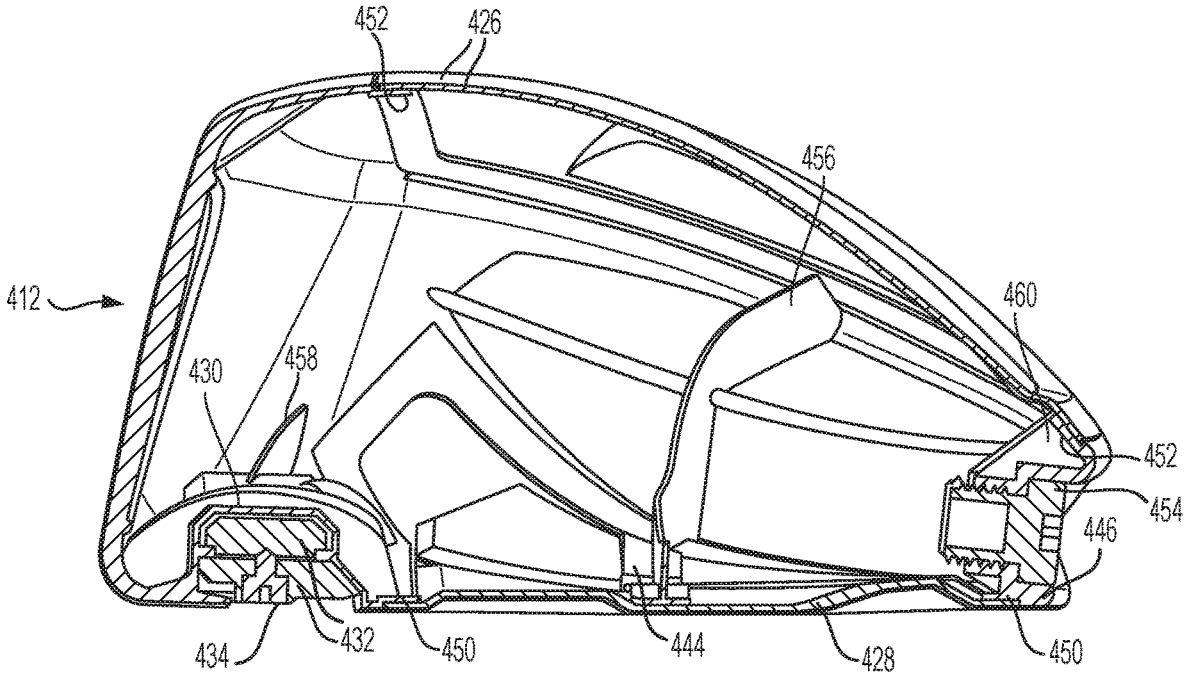
FIG. 24 is a vertical sectional view of the club head of FIG. 21 taken along line 24-24 of FIG. 22.

FIG. 24 is a vertical cross-section view along a generally centered longitudinal axis extending in the fore-aft direction. The figure shows the forward face area 412, crown insert 426, sole insert 428, lateral weight track 430, two-piece lateral weight 432, weight locking screw 434, tie rib 444, aft weight port 446, and sole insert mounting shelf 450. It also illustrates that the crown insert 426, like the sole insert, is mounted over a crown opening in the main body by securing the crown insert to a ledge or shelf 452 along the periphery of the crown opening. The crown insert 426 may be secured to the crown opening (and main body) by adhesion, like the sole insert.

A threaded weight 454 is shown threadably received in one of the fixed weight ports 446, which provides a complementary shaped threaded opening to receive the weight. Fixed weight(s) 454 may be removably fastened to the toe-side aft weight port, heel-side aft weight port, or both.

FIG. 24 also illustrates that other internal ribs, such as rib(s) 456, lateral weight track rib(s) 458 and fixed weight port rib(s) 460 may be integrally formed with or attached to the main body. Such ribs can vary in size, shape, location, number and stiffness, and used strategically to reinforce or stiffen designated areas of the main body's interior and/or fine tune acoustic properties of the club head.

Figure 25:
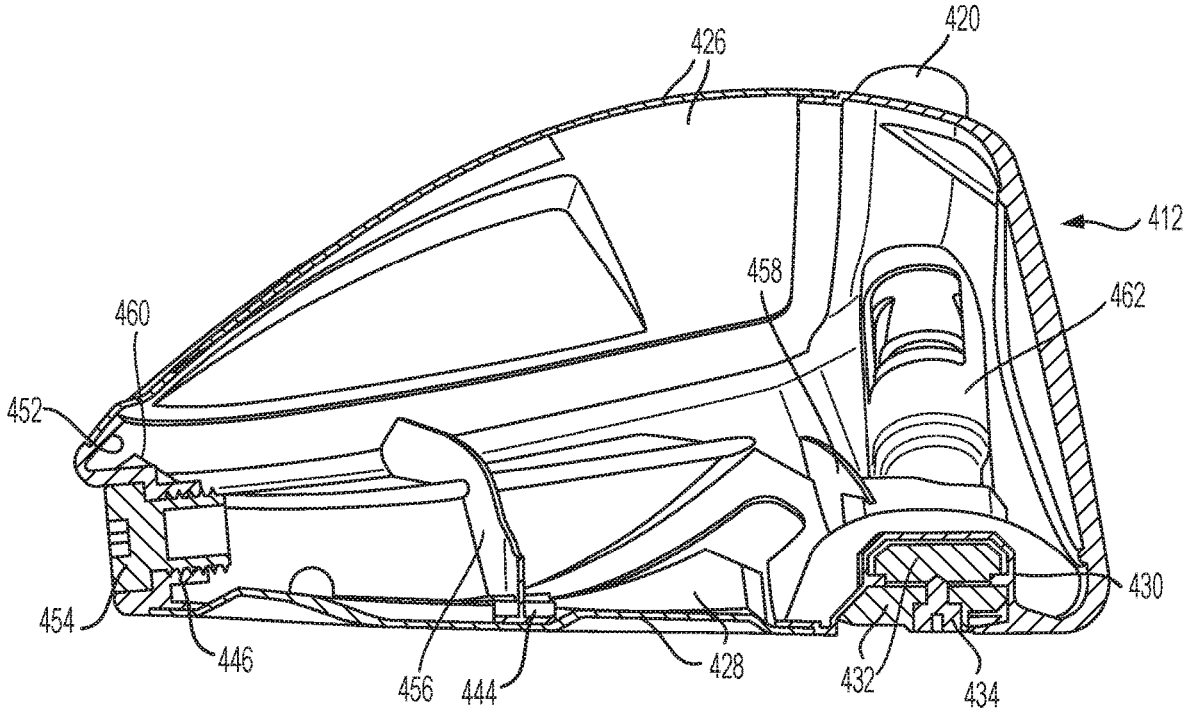
FIG. 25 is a vertical cross-section view of the club head of FIG. 21 taken along line 25-25 of FIG. 22.

FIG. 25 provides a similar vertical cross section view as FIG. 24 but looking in the opposite direction toward the heel of the club head. Unlike FIG. 24, FIG. 25 shows an adjustable FCT component or system 462 aligned with the hosel 420 to removably mount a golf shaft to the club head and permit the lie and loft of the club head to be adjusted.

Figure 26:
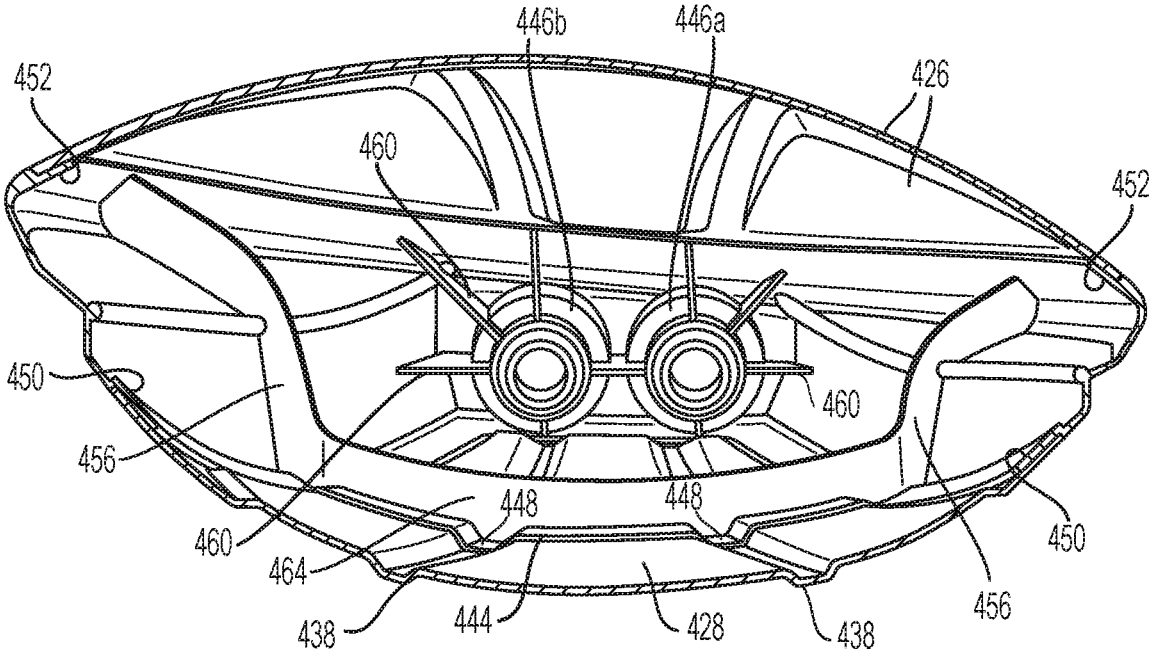
FIG. 26 is a vertical cross-section view of the club head of FIG. 21 taken along line 26-26 of FIG. 22.

FIG. 26 is a vertical section view taken along a lateral axis located generally mid-way between the forward face 412 and rearmost portion of the club head. It illustrates that a cross rib 464 may laterally span the interior of the club head and join opposing side ribs 456. It further illustrates how the raised portions 448 of the tie rib 444 mate with interior channels formed in the sole insert 428. The exterior of these interior channels can be seen as outer ribs 438 in FIGS. 22 and 26.

As shown in Table 2 below, one or more embodiments of the present disclosure are able to achieve high MOI (Ixx and Izz), relatively low CG ($CG_z$) and a desirable Center of Gravity projection on the club face, also known as "balance point on the face" (BP Proj.). "Front d mass" denotes the mass of the slidable weight 432 in the lateral weight track 430. For example, the front slidable weight may be 10 g, 20 g or 15 g, as well as other values. "Back d mass" denotes the mass of the fixed aft weight(s), and includes the combined mass of weights in both weight ports 446*a, b* if two weights are installed. The back d mass (one or two weights), for example, may be 20 g, 10 g, 15 g or some other value. CGx and CGz represent center of gravity locations on the x and z coordinate axes, respectively.

Delta 1 (D1) represents the distance between the club head's CG and its hosel axis along the Y axis (in a direction straight toward the back of the body of the club head face from the geometric center of the face). Thus, for embodiments disclosed herein in which the projected CG (BP Proj.) on the ball striking face is lower than the geometric center, reducing Delta 1 produces a lower projected CG and a lower dynamic loft and creates a desirable further reduction in backspin due to the Z-axis gear effect. Thus, the embodiment of FIGS. 21-26 (and other embodiments disclosed herein) facilitate a club design having a desirable high launch angle and yet relatively low spin rate. High launch trajectories are normally associated with higher spin rates.

"Mass" denotes the mass of the club head in grams. Ixx and Izz denote the moment of inertia of the club head about the x and z axes, respectively.

The values in Table 2 below represent club heads having a composite crown/composite sole and volume of about 460 $cm^3$.

TABLE 2

| Front dMass | Back dMass | CGx (mm) | CGz (mm) | D1 (mm) | Mass (g) | IXX $g \cdot mm^2$ | IZZ $g \cdot mm^2$ | BP Proj (mm) |
|---|---|---|---|---|---|---|---|---|
| 10 g | 20 g | 0.7 | −4.8 | 25.5 | 205.2 | 390 | 532 | 2.2 |
| 20 g | 10 g | 0.9 | −5.2 | 18.9 | 205.2 | 344 | 484 | 1 |
| 15 g | 15 g | 1.1 | −5.1 | 23.1 | 205.2 | 370 | 510 | 1.6 |

In this instance the foregoing properties and values are achieved with a laterally adjustable, forward-located weight and a pair of fixed weight ports located centrally and rearwardly on the club head, both of which may be integrally formed and cast as part of the main body or frame. The foregoing properties and values may also be achieved with relatively light polymer (or composite) sole and crown inserts.

A method of making a golf club may include one or more of the following steps:

- forming a frame having a sole opening, forming a composite laminate sole insert, injection molding a thermoplastic composite head component over the sole insert to create a sole insert unit, and joining the sole insert unit to the frame.
- wherein providing a composite head component which is a weight track capable of supporting one or more slidable weights.
- forming the sole insert from a thermoplastic composite material having a matrix compatible for bonding with the weight track.
- forming the sole insert from a continuous fiber composite material having continuous fibers selected from the group consisting of glass fibers, aramide fibers, carbon fibers and any combination thereof, and having a thermoplastic matrix consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof.
- forming both the sole insert and weight track from thermoplastic composite materials having a compatible matrix.
- forming the sole insert from a thermosetting material, coating the sole insert with a heat activated adhesive, and forming the weight track from a thermoplastic material capable of being injection molded over the sole insert after the coating step.
- forming the frame from a material selected from the group consisting of titanium, one or more titanium alloys, aluminum, one or more aluminum alloys, steel, one or more steel alloys, and any combination thereof.

forming the frame with a crown opening, forming a crown insert from a composite laminate material, and joining the crown insert to the frame such that the crown insert overlies the crown opening.

selecting a composite head component from the group consisting of one or more ribs to reinforce the head, one or more ribs to tune acoustic properties of the head, one or more weight ports to receive a fixed weight in a sole portion of the club head, one or more weight tracks to receive a slidable weight, and combinations thereof.

forming the sole insert and crown insert from a continuous carbon fiber composite material.

forming the sole insert and crown insert by thermosetting using materials suitable for thermosetting, and coating the sole insert with a heat activated adhesive.

forming the frame from titanium, titanium alloy or a combination thereof and has a crown opening, and the sole insert and weight track are each formed from a thermoplastic carbon fiber material having a matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof.

forming the frame with a crown opening, forming a crown insert from a thermoplastic composite material, and joining the crown insert to the frame such that it overlies the crown opening.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A golf club head having a sole, crown and striking face, comprising:

a frame having at least one sole opening in the sole, the frame being made at least in part of a metal or metal alloy;

a sole insert made of a polymeric material;

a weight track made of a moldable material which is joined to the sole insert to form a sole insert unit, the weight track retaining one or more slideable weights which are selectively moveable within the weight track to adjust a center of gravity of the club head;

wherein the one or more slideable weights are located on an external surface of the sole;

wherein the sole insert unit is joined to the frame to cover the at least one sole opening.

2. The golf club head of claim 1 wherein the weight track extends in a generally front to back direction on the frame.

3. The golf club head of claim 2 wherein the one or more slideable weights are adjustable to vary a Delta 1 of the club head by about 9.6 to 28.1 mm.

4. The golf club head of claim 2 wherein the sole insert unit includes a first rib extending along an internal surface of the sole insert in a first direction.

5. The golf club head of claim 4 wherein the sole insert unit includes a second rib extending along an internal surface of the sole insert in a second direction.

6. The golf club head of claim 5 wherein the first and second ribs intersect.

7. The golf club head of claim 2 wherein the sole insert is made of a composite laminate material.

8. The golf club head of claim 2 wherein the sole insert is made of a thermoplastic composite laminate material.

9. The golf club head of claim 2 wherein the sole insert is thermoformed from a continuous carbon fiber composite material.

10. The golf club head of claim 2 wherein the frame is made of a material selected from the group consisting of titanium, one or more titanium alloys, aluminum, one or more aluminum alloys, steel, one or more steel alloys, and any combination thereof and sole insert is made from a thermoplastic carbon composite material.

11. The golf club head of claim 10 wherein the sole insert has a surface area of about 20 to 50% of a surface of a sole portion of the club head.

12. The golf club head of claim 11 including a lateral weight track formed integrally as part of the frame, and one or more weights slideably retained by the lateral weight track to permit lateral toe-heel adjustment of the center of gravity.

13. The golf club head of claim 2 including an adjustable head-shaft connection assembly comprising a sleeve secured by a fastening member in a locked position, the head-shaft connection assembly configured to allow the golf club head to be adjustably attachable to a golf club shaft in a plurality of different positions resulting in different combinations of loft angle, face angle, or lie angle.

14. The golf club head of claim 2 wherein the frame has at least one crown opening in the crown, and the club head further includes a crown insert made of a polymeric material which is joined to the frame to cover the crown opening.

15. The golf club head of claim 1 wherein the weight track is joined to the sole insert by injection molding, insert molding or overmolding.

16. A golf club head having a sole, crown, striking face and hosel, comprising:

a frame made at least in part of a metal or metal alloy and having at least one sole opening;

a sole insert unit made of a polymeric material and including a weight track for retaining one or more adjustable weights in different select positions along the weight track to facilitate adjustment of a center of gravity of the club head;

wherein the sole insert unit is joined to the frame to cover the at least one sole opening;

wherein the weight track extends in a generally front to back direction and the weights retained by the weight track are located on an external surface of the sole;

wherein the sole insert unit includes one or more insert ribs extending along an internal surface of the sole insert; and a hosel rib extending from the hosel to an internal surface of the sole.

17. The golf club head of claim 16 wherein the frame and hosel rib are made of a common first material having a first density, the one or more insert ribs are made of a second material having a second density, the first density being at least twice the density of the second density.

18. The golf club head of claim 17 wherein the sole insert unit is made of a thermoplastic composite laminate material.

19. A golf club head having a sole, crown and striking face, comprising:

a frame having a hollow interior which is made at least in part of a metal or metal alloy and has a sole opening and crown opening;

a sole insert unit made of polymeric material and including a weight track for retaining one or more adjustable weights in different select positions along the weight track to facilitate adjustment of a center of gravity of the club head;

wherein the sole insert is joined to the frame to cover the sole opening, such that the weight track is generally centrally located on the sole and extends generally in a front to back direction, the one or more adjustable weights being located on an exterior surface of the sole;

a crown insert made of a polymeric material and joined to the frame to cover the crown opening; and a plurality of ribs extending in different directions along an internal surface of the sole, wherein two or more of the ribs are made of different materials having different densities.

20. The golf club of claim 19 wherein the sole insert unit and crown insert are made of a composite laminate material.

* * * * *